US006013423A

United States Patent [19]

Hirano et al.

[11] Patent Number: 6,013,423

[45] **Date of Patent: *Jan. 11, 2000**

[54] DEVELOPING SOLUTION FOR SILVER HALIDE PHOTOGRAPHIC MATERIAL AND METHOD FOR PROCESSING SILVER HALIDE PHOTOGRAPHIC MATERIAL BY USING THE SAME

[75] Inventors: Mitsunori Hirano; Kiyoshi Morimoto; Tetsuo Yoshida; Kunio Ishigaki, all of Kanagawa, Japan

[73] Assignee: Fuji Photo Film Co., Ltd., Kanagawa, Japan

[ * ] Notice: This patent is subject to a terminal disclaimer.

[21] Appl. No.: 08/193,641

[22] Filed: Feb. 7, 1994

Related U.S. Application Data

[63] Continuation-in-part of application No. 07/933,243, Aug. 21, 1992, abandoned.

[30] Foreign Application Priority Data

| | | | |
|---|---|---|---|
| Aug. 22, 1991 | [JP] | Japan | 3-233718 |
| Aug. 27, 1991 | [JP] | Japan | 3-238880 |
| Aug. 30, 1991 | [JP] | Japan | 3-244041 |

[51] Int. Cl.[7] ..... G03C 5/29

[52] U.S. Cl. ..... 430/445; 430/446; 430/488

[58] Field of Search ..... 430/445, 446, 430/486, 488, 490

[56] References Cited

U.S. PATENT DOCUMENTS

| | | | |
|---|---|---|---|
| 3,597,199 | 8/1971 | Glockner et al. | 430/379 |
| 4,254,215 | 3/1981 | Kramp et al. | 430/488 |
| 4,310,622 | 1/1982 | Onda et al. | 430/488 |
| 4,551,424 | 11/1985 | Ikeda et al. | 430/429 |
| 5,108,872 | 4/1992 | Inoue et al. | 430/445 |
| 5,240,823 | 8/1993 | Yamada et al. | 430/488 |
| 5,356,761 | 10/1994 | Morimoto et al. | 430/488 |

FOREIGN PATENT DOCUMENTS

| | | | |
|---|---|---|---|
| 47-25386 | 7/1972 | Japan | 430/488 |
| 59-204037 | 11/1984 | Japan . | |

*Primary Examiner*—Hoa Van Le
*Attorney, Agent, or Firm*—Sughrue, Mion, Zinn Macpeak & Seas, PLLC

[57] ABSTRACT

A developing solution for silver halide photographic material contains a six-membered heterocyclic compound having two nitrogen atoms as the constituent atoms of the six-membered ring and mercapto group, hydroxyl group and at least one substituent group other than hydrogen atom and a five-membered heterocyclic compound having two to three nitrogen atoms as the constituent atoms of the five-membered ring and at least one mercapto group. There is also disclosed a method for processing a silver halide photographic material with said developing solution.

5 Claims, No Drawings

DEVELOPING SOLUTION FOR SILVER HALIDE PHOTOGRAPHIC MATERIAL AND METHOD FOR PROCESSING SILVER HALIDE PHOTOGRAPHIC MATERIAL BY USING THE SAME

This is a Continuation-In-Part of application Ser. No. 07/933,243 filed Aug. 21, 1992, now abandoned.

FIELD OF THE INVENTION

This invention relates to a developing solution for silver halide photographic materials and a method for processing the silver halide photographic materials by using the same. More particularly, it relates to a method which reduces silver stain (sometimes called silver sludge) deposited on the walls of developing tanks, development racks and rollers during the course of the development of rapid processable photographic materials and thereby allows the maintenance of automatic processors to be easily made.

BACKGROUND OF THE INVENTION

Generally, the use of automatic processors is increasing from the viewpoints of rapid processing, simplicity and handling in the processing of silver halide photographic materials. Further, a large amount of sulfites is used in the developing solutions in the processing of black and white photographic materials to keep the development activity of the developing solutions, that is, to minimize the oxidation of the developing solutions by air.

The demand of rapid processing has been increased in recent years. The activity of the developing solutions must be increased to carry out rapid processing. When the concentrations of developing agents are increased or when the pH of the developing solutions are raised, the activity of the developing solutions can be increased. However, the developing solutions are greatly deteriorated by oxidation by air and it is difficult to keep the activity of the developing solutions.

Generally, sulfites are added to the developing solutions to keep the activity of the developing solutions. However, when silver halide photographic materials are processed with the developing solutions containing compounds having a function capable of dissolving silver halide, such as the sulfites, a large amount of a silver complex is dissolved out from the silver halide photographic materials into the developing solutions. The silver complex dissolved out from the photographic materials into the developing solutions is reduced by the developing agents, and silver is deposited and accumulated on the walls of the developing tanks or trays, or on the walls of the developing tank of the automatic processors, the rolls thereof, etc. The deposited silver is called silver stain or silver sludge and further deposited on the photographic materials to be processed to thereby stain images. Accordingly, the maintenance of apparatuses must be made by washing periodically them.

Accordingly, when the amount of the sulfite is increased to keep the activity of the developing solutions, the amount of the silver complex dissolved out from the photographic materials into the developing solutions is increased, and the degree of silver stain is increased. Hence, there is a disadvantage that a merit in rapid processing can not be fully used.

Conventional methods for reducing silver stain include those wherein compounds capable of decreasing the amount of silver ion dissolved out and/or inhibiting the reduction of silver ion to silver are added as described in JP-A-56-24347 (the term "JP-A" as used herein means an "unexamined published Japanese patent application"), JP-B-56-46585 (the term "JP-B" as used herein means an "examined Japanese patent publication") and JP-B-62-2849. However, these compounds have an effect of retarding development itself or are oxidized by air and rapidly lose their effet, and hence these compounds are not considered to be satisfactory silver stain inhibitors.

Scanner systems are widely used in the field of printing plate making. Various recording apparatuses using image forming methods according to the scanner systems are proposed.

Light sources for use in the recording of these scanner system recording apparatuses include glow lamp, xenon lamp, tungsten lamp, LED, He-He laser, argon laser and semiconductor laser.

Light-sensitive materials in this field must be spectral-sensitized (by adding dyes) to adjust spectral sensitivity to the wavelength of light emitted from the above light sources. Further, various dyes are generally added to the light-sensitive materials to ensure safety under safelight or to prevent irradiation or halation.

When reflection supports are used, an image is usually formed on a white ground, and a residual color resulting from the use of dyes or spectral sensitizing dyes is noticeable in comparison with transparent supports.

Rapid processing has been demanded in the field of printing industry in recent years to shorten the delivery time. Residual color is a serious problem caused by rapid processing.

Residual color can be reduced by decreasing the amount of the binder in the light-sensitive material (particularly protective layer). However, the amount of silver dissolved out from the light-sensitive material into the developing solution is increased, and silver sludge deposited on the rollers of the automatic processor is transferred to the light-sensitive material. namely, there is a disadvantage that silver stain is worsened.

SUMMARY OF THE INVENTION

Accordingly, the first object of the present invention is to (1) reduce silver stain on the walls of developing tanks and/or on development racks and rollers, (2) enables the maintenance of automatic processors and development apparatuses to be easily made, (3) reduce silver stain without any adverse effect on photographic characteristics at all, and (4) reduce silver stain without detriment to the stability of developing solutions when a rapid processable silver halide photographic materials is processed.

The second object of the present invention is to provide a method for processing a silver halide photographic material having a reflection support which forms little residual color and scarcely suffers from silver stain.

The third object of the present invention is to provide a method for processing a silver halide photographic material which has rapid processability, enables silver stain to be reduced and allows the replenishment rates of processing solutions to be reduced.

The above-described first object of the present invention has been achieved by providing a developing solution for silver halide photographic materials which contains a six-membered heterocyclic compound having two nitrogen atoms as the constituent atoms of the six-membered ring and mercapto group, hydroxyl group and at least one substituent group other than hydrogen atom and a five-membered heterocyclic compound having one to three nitrogen atoms as the constituent atoms of the five-membered ring and at least one mercapto group.

The above-described second object of the present invention has been achieved by providing a method for processing a silver halide photographic material comprising a reflection support having thereon at least one light-sensitive emulsion layer containing silver halide grains (and at least one protective layer containing gelatin), characterized by that said silver halide photographic material having said protective layer having a gelatin content of not more than 1.5 g/m$^2$ is processed with a developing solution containing a six-membered heterocyclic compound represented by general formula (I) described hereinafter.

The above-described third object of the present invention has been achieved by providing a method for processing a silver halide photographic material comprising a support having thereon at least one silver halide emulsion layer and at least one protective layer provided on said emulsion layer after exposure, characterized by that the swelling ratio of the hydrophilic colloid layers of said silver halide photographic material, which include said emulsion layer and said protective layer, is not higher than 150%, and said silver halide photographic material is processed with a developing solution containing a six-membered heterocyclic compound represented by general formula (I) described hereinafter.

DETAILED DESCRIPTION OF THE INVENTION

Now, the present invention will be illustrated in more detail below.

Six-membered heterocyclic compounds having two nitrogen atoms as the constituent atoms of the six-membered ring and mercapto group, hydroxyl group and at least one substituent group other than hydrogen atom which are used in the present invention are preferably compounds represented by the following general formula (I).

(I)

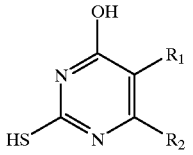

In general formula (I), $R_1$ and $R_2$ each represents hydrogen atom, an alkyl group, an aryl group, an aralkyl group, hydroxyl group, a mercapto group, carboxyl group, sulfo group, phosphono group, an amino group, nitro group, cyano group, a halogen atom, an alkoxycarbonyl group, an aryloxycarbonyl group, a carbamoyl group, a sulfamoyl group or an alkoxy group. The alkyl group, the aryl, the aralkyl group, the amino group, the alkoxycarbonyl group, the aryloxycarbonyl group, the carbamoyl group, the sulfamoyl group and the alkoxy group may be further substituted. Examples of substituent groups include groups already described above in the definition of $R_1$ and $R_2$. If desired, $R_1$ and $R_2$ may be combined together to form a ring.

Preferably, either one of $R_1$ and $R_2$ is an alkyl group having 1 to 10 carbon atoms which may be substituted, an aryl group having 6 to 12 carbon atoms which may be substituted, an aralkyl group having 7 to 12 carbon atoms which may be substituted, nitro group, cyano group and halogen. The sum total of carbon atoms in $R_1$ and $R_2$ is preferably 2 to 20. The case where $R_1$ and $R_2$ are combined together to form a five-membered or six-membered saturated ring is also preferred.

More preferably, $R_1$ is hydrogen atom or an alkyl group which is substituted by an amino group (e.g., dimethylamino, diethylamino) or a heterocyclic group (e.g., morpholino, N-methylpiperazinyl, pyrrolidinyl, piperidinyl), and $R_2$ is an alkyl group having 1 to 10 carbon atoms which may be substituted or an aryl group having 6 to 12 carbon atoms which may be substituted. The case where $R_1$ and $R_2$ are combined together to form a five-membered or six-membered saturated ring is also included in the more preferred embodiment. Specific examples of $R_1$ include dimethylaminomethyl group, morpholinomethyl group, N-methylpiperadinylmethyl group and pyrrolidinylmethyl group. Specific examples of $R_2$ include methyl group, ethyl group, phenyl group and p-methoxyphenyl group.

Five-membered heterocyclic compounds having one to three nitrogen atoms as the constituent atoms of the five-membered ring and at least one mercapto group which are used in the present invention are preferably compounds represented by the following general formula (II).

(II)

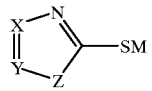

In general formula (II), X and Y each represents nitrogen atom or $CR_3$; Z represents sulfur atom or $NR_4$; and X and Y may be combined together to form a condensed ring. The number of nitrogen atoms as the constituent atoms of the five-membered ring is at least one, but not more than three. Preferably, the number of nitrogen atoms as the constituent atoms of the five-membered ring is two.

$R_3$ and $R_4$ each represents hydrogen atom, an alkyl group, an aryl group, an aralkyl group, hydroxyl group, mercapto group, carboxyl group, sulfo group, phosphono group, an amino group, nitro group, cyano group, a halogen atom, an alkoxycarbonyl group, an aryloxycarbonyl group, a carbamoyl group, a sulfamoyl group or an alkoxy group. The alkyl group, the aryl group, the aralkyl group, the amino group, the alkoxycarbonyl group, the aryloxycarbonyl group, the carbamoyl group, the sulfamoyl group and the alkoxy group may be further substituted. Examples of substituent groups include groups already described above in the definition of $R_3$ and $R_4$.

Preferably, $R_3$ and $R_4$ are each hydrogen atom, an alkyl group having 1 to 10 carbon atoms which may be substituted, an aryl group having 6 to 12 carbon atoms which may be substituted, pyridyl group, sulfo group, carboxyl group or hydroxyl group. The case where X and Y are combined together to form a condensed ring is also preferred. Preferred examples of the condensed ring include cyclopentene ring, cyclohexene ring, benzene ring, pyridine ring and pyrimidine ring. These rings may be substituted by sulfo group, carboxyl group or hydroxyl group.

M represents hydrogen atom, an alkali metal atom, quaternary ammonium or quaternary phosphonium.

Examples of the compounds of general formula (I) which can be used in the present invention include, but are not limited to, the following compounds.

I-1
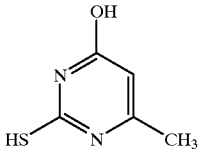
I-2
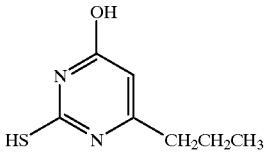
I-3
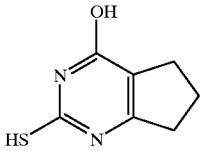
I-4
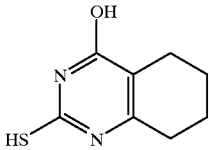
I-5
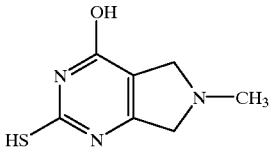
I-6
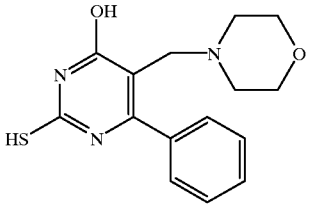
I-7
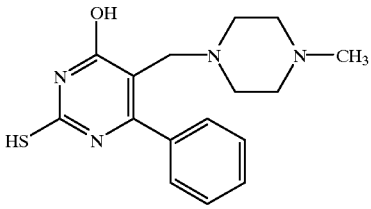
I-8
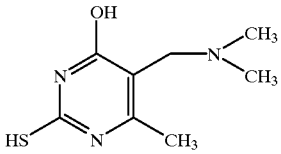
I-9
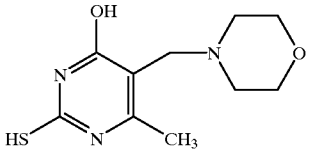
-continued
I-10
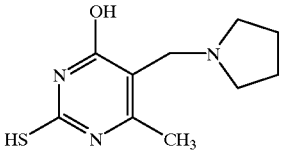
I-11
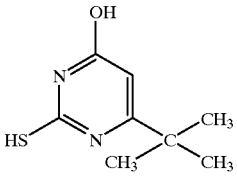
I-12
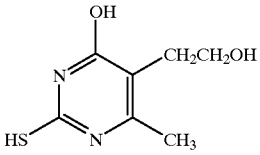
I-13
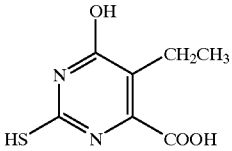
I-14
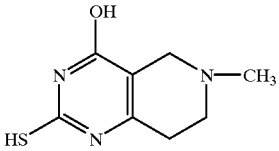
I-15
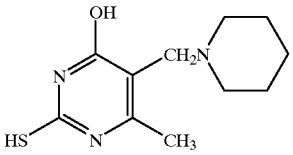
I-16
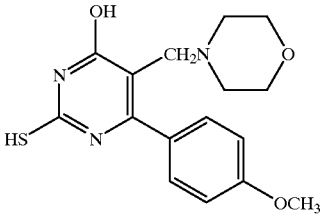
I-17
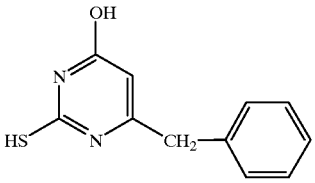

-continued
(I-18)
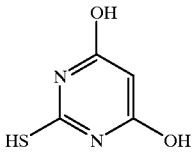
(I-19)
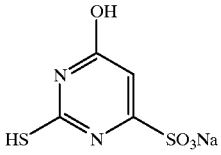
(I-20)
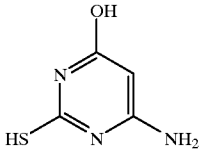
(I-21)
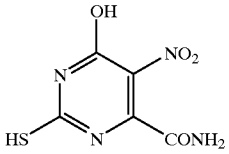
(I-22)
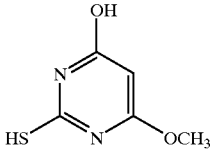
(I-23)
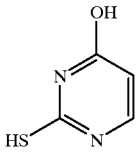
Examples of the compounds of general formula (II) which can be used in the present invention include, but are not limited to, the following compounds.
II-1
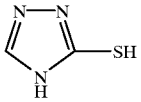
II-2
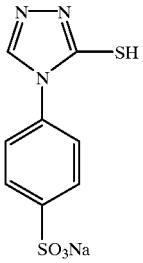
-continued
II-3
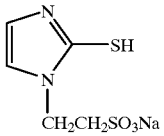
II-4
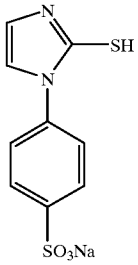
II-5
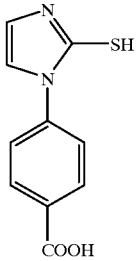
II-6
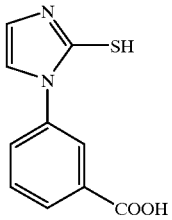
II-7
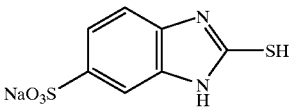
II-8
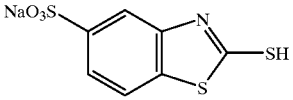
II-9
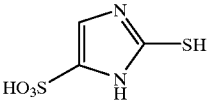
II-10
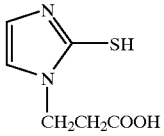
II-11
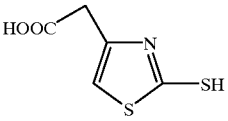

-continued

II-12

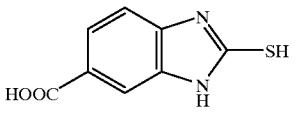

II-13

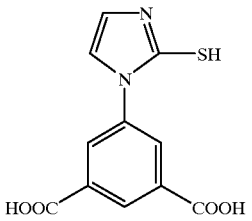

II-14

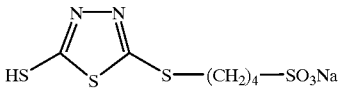

The above-described compounds can be easily synthesized by methods conventionally known. For example, these compounds can be prepared according to the methods described in U.S. Pat. Nos. 2,585,388, 2,541,924 and 3,266,897, U.K. Patent 1,275,701, JP-A-56-111846, JP-B-42-21842, *Journal of Heterocyclic Chemistry*, Vol. 15, No. 981 (1978), *Comprehensive Heterocyclic Chemistry*, Vol 3, pp. 40–56, pp. 106–142 and pp. 179–191, and *The Journal of American Chemical Society*, Vol. 67, 2197–2200 (1945).

Both of the compounds of the present invention are used in an amount of preferably 0.01 to 100 mmol, more preferably 0.1 to 10 mmol per liter of the developing solution. The mixing ratio of the compound of general formula (I) and the compound of general formula (II) may be arbitrarily varied, but it is preferred that these compounds are used in a ratio by mol of the compound of general formula (I) to the compound of general formula (II) of 1:100 to 0.01, more preferably 1:10 to 0.1.

Developing solutions which are used in the processing of the light-sensitive materials in the present invention may contain conventional additives (e.g., developing agent, alkaline agent, pH buffering agent, preservative, chelating agent). Any of conventional development methods can be used in the present invention, and the developing solutions of the present invention may contain any of conventional developing agents. Though there is no particular limitation with regard to the developing agents to be contained in the developing solutions, it is preferred that the developing solutions contain dehydroxybenzenes. The combination of the dihydroxybenzenes with 1-phenyl-3-poyrazolidones or the combination of the dihydroxybenz-enes with p-aminophenols are more preferred from the viewpoint of development performance.

Examples of the dihydroxybenzene developing agents which can be used in the present invention include hydroquinone, chlorohydroquinone, isopropylhydroquinone and methylhydroquinone. Among them, hydroquinone is particularly preferred.

Examples of 1-phenyl-3-pyrazolidone and derivatives which can be used as the developing agents in the present invention include 1-phenyl-3-pyrazolidone, 1-phenyl-4,4-dimethyl-3-pyrazolidone and 1-phenyl-4-methyl-4-hydromethyl-3-pyrazolidone.

Examples of p-aminophenol developing agents which can be used in the present invention include N-methyl-p-aminophenol, p-aminophenol, N-(β-hydroxyethyl)-p-aminophenol and N-(4-hydroxyphenyl)glycine. Among them, N-methyl-p-aminophenol is preferred.

The dihydroxybenzene developing agents are used in an amount of preferably 0.05 to 0.8 mol/l. When the dihydroxybenzenes are used in combination with the 1-phenyl-3-pyrazolidones or the p-aminophenols, the former is used in an amount of preferably 0.05 to 0.5 mol/l and the latter is used in an amount of preferably not more than 0.06 mol/l.

Examples of preservatives which can be used in the present invention include sodium sulfite, potassium sulfite, lithium sulfite, ammonium sulfite, sodium bisulfite, potassium metabisulfite and formaldehyde sodium bisulfite adducts. The sulfites may be used in an amount of at least 0.20 mol/l, preferably at least 0.3 mol/l. However, when excessively large amount of the sulfite is used, the sulfite is precipitated in the developing solution to thereby contaminate the solution. Hence, it is desirable that the upper limit is 1.2 mol/l.

Examples of alkaline agents which can be used to adjust pH include conventional inorganic alkali salts (e.g., sodium hydroxide, potassium hydroxide, sodium carbonate, potassium carbonate).

Other additives which can be used in the present invention include restrainers such as sodium bromide and potassium bromide; organic solvents such as ethylene glycol, diethylene glycol, triethylene glycol and di-methylformamide; development accelerators such as alkanolamines (e.g., diethanolamine, triethanolamine), imidazole and derivatives thereof; and anti-fogging agents or black pepper inhibitors such as mercapto compounds (e.g., 1-phenyl-5-mercaptotetrazole), indazole compounds (e.g., 5-nitroindazole) and benztriazole compounds. Further, the developing solutions may optionally contain color toning agents, surfactants, anti-foaming agents, water softeners, hardening agents, etc.

Furthermore, compounds, as development blurs inhibitors, described in JP-A-62-212651 and compounds, as dissolution aids, described in JP-A-61-267759 can be used.

The developing solutions of the present invention may contain, as buffering agents, boric acid compounds described in JP-A-62-186259, saccharide (e.g., saccharose) described in JP-A-60-93433, oximes (e.g., acetoxime), phenols (e.g., 5-sulfosalicylic acid) and tertiary phosphates (e.g., sodium salt, potassium salt). among them, boric acid is preferred.

It is preferred from the viewpoints of transport costs, packaging material costs and space saving that the processing solutions are concentrated and the concentrates are diluted when used. It is effective that salt components contained in the developing solutions are in the form of potassium salt to concentrate the developing solutions.

Fixing agents to be contained in fixing solution used in the present invention include sodium thiosulfate and ammonium thiosulfate. Ammonium thiosulfate is particularly preferred from the viewpoint of the rate of fixing. The amounts of these conventional fixing agents to be used can be properly varied, but are generally about 0.1 to about 2 mol/l.

If desired, the fixing solutions may contain hardening agents (e.g., water-soluble aluminum compounds), preservatives (e.g., sulfites, bisulfites), pH buffering agents (e.g., acetic acid, boric acid), pH adjustors (e.g., ammonia, sulfuric acid), chelating agents, surfactants and fixing accelerators.

Examples of the surfactants include anionic surfactants such as sulfated compounds and sulfonated compounds, polyethylene surfactants and ampholytic surfactants (e.g., those described in JP-A-57-6740). Conventional anti-foaming agents may be added. Examples of the wetting agents include alkanolamines and alkylene glycols. Examples of the fixing accelerators include thiourea derivatives and alcohols having a triple bond in the molecule described in JP-B-45-35754, JP-B-58-122535 and JP-B-58-122536 and thioether compounds described in U.S. Pat. No. 4,126,459. Compounds described in JP-A-2-44355 can also be used.

Examples of the pH buffering agents include organic acids such as acetic acid, malic acid, succinic acid, tartaric acid and citric acid and inorganic buffering agents such as boric acid, phosphates and sulfites. Among them, acetic acid, tartaric acid, boric acid and sulfites are preferred.

The pH buffering agents are used to prevent the pH of the fixing solutions from being raised by the developing solutions carried over. The pH buffering agents are used in an amount of preferably 0.01 to 1.0 mol/l, more preferably 0.02 to 0.6 mol/l.

Further, compounds described in JP-A-64-4739 can be used as dye dissolving-out accelerators.

Examples of the hardening agents which can be used in the fixing solutions of the present invention include water-soluble aluminum salts and chromium salts. Preferred compounds are water-soluble aluminum salts such as aluminum chloride, aluminum sulfate and potash alum. The hardening agents are used in an amount of preferably 0.01 to 0.2 mol/l, more preferably 0.03 to 0.08 mol/l.

The effect of the present invention can be obtained, irrespective of whether the hardening agent is used or not.

The fixing temperature and time are preferably about 20 to about 50° C. for 5 to 60 seconds. The replenishment rate of the fixing solution is preferably not more than 600 ml/m$^2$, particularly preferably not more than 450 ml/m$^2$.

After development and fixing, the light-sensitive materials are subjected to a rinsing or stabilizing treatment. The rinsing or stabilizing treatment can be carried out by using a replenishment rate of not more than 3 liters (including 0, that is, rinsing with standing water) per m$^2$ of the silver halide photographic material. Namely, not only a treatment in a water saving manner can be carried out, but also the treatment can dispense with piping for providing an automatic processor.

When the rinsing stage is carried out with a small amount of water, it is preferred that a washing tank for squeeze rollers and cross-over rollers as described in JP-A-63-18350 and JP-A-62-287250 is provided. If desired, the washing tank may be used in combination with the addition of various oxidizing agents or filtration through a filter to reduce environmental pollution caused by washing with a small amount of water.

Further, a part or the whole of an overflow solution from the rinsing or stabilizing bath can be used as a processing solution having a fixing ability used in the fixing stage prior to the rinsing or stabilizing stage as described in JP-A-60-235133, said overflow solution being obtained by replenishing the rinsing or stabilizing bath with water containing an antifungal agent according to processing.

A water-soluble surfactant or an anti-foaming agent may be added to prevent unevenness in foaming from being caused and/or to prevent processing agent components deposited on the squeeze rollers from being transferred to the processed film, said unevenness in foaming and said deposition of the processing agent components on the rollers being liable to be caused when rinsing is carried out with a small amount of water.

The rinsing tank may contain dye adsorbents described in JP-A-63-163456 to prevent rinsing water from being contaminated by dyes dissolved out from the light-sensitive material.

The stabilizing treatment subsequent to the rinsing treatment is sometimes carried out. In this case, a bath containing compounds described in JP-A-2-201357, JP-A-2-132435, JP-A-1-102553 and JP-A-46-44446 may be used as the final bath for the light-sensitive material.

The stabilizing bath may optionally contain ammonium compounds, metallic compounds such as Bi and Al compounds, fluorescent brighteners, various chelating agents, pH adjustors for layers, hardening agents, germicides, mildewproofing agents, alkanolamines and surfactants. Preferred examples of water used in the rinsing or stabilizing stage include tap water, deionized water and water sterilized by ultraviolet germicidal lamp or various oxidizing agents (e.g., hydrogen peroxide, perchlorates). Rinsing water containing compounds described in JP-A-2-147076 may be used.

In the development of the present invention, the development time is not longer than 60 seconds, preferably 6 to 30 seconds, and the development temperature is preferably 25 to 50° C., more preferably 30 to 40° C.

The fixing temperature and time are preferably about 20 to about 50° C. for 60 seconds or shorter, more preferably 30 to 40° C. for 6 to 30 seconds.

The rinsing or stabilizing temperature and time are preferably 0 to 50° C. for 60 seconds or shorter, more preferably 10 to 40° C. for 6 to 30 seconds.

According to the present invention, rinsing water is fully squeezed out from the light-sensitive material after development, fixing and rinsing (or stabilization). Namely, the light-sensitive material is dried through the squeeze rollers. Drying is carried out at a temperature of about 40 to about 100° C.

The drying time can be properly varied depending on ambient conditions.

Silver halide emulsions used in the present invention comprise silver halide such as silver chloride, silver iodide, silver bromide, silver chlorobromide, silver iodobromide or silver chloroiodobromide dispersed in hydrophilic colloid.

The silver halide emulsions can be prepared by mixing a water-soluble silver salt (e.g., silver nitrate) with a water-soluble halide in the presence of water and hydrophilic colloid in a conventional manner (e.g., single jet process, double jet process, controlled jet process) and carrying out physical ripening and chemical ripening such as gold sensitization and/or sulfur sensitization. There is no particular limitation with regard to the form of silver halide grains used in the present invention. The silver halide grains may have a cubic or octahedral form. Tabular silver halide grains having a high aspect ratio described in *Research Disclosure* 22534 (January 1983) can also be used.

In the case of X-ray photographic materials, tabular silver halide emulsions are preferable. In this case, silver bromide or silver iodobromide having a silver iodide content of preferably not higher than 10 mol %, particularly preferably 0 to 5 mol % is preferred. Emulsions comprising silver bromide or silver iodobromide give high-sensitivity photographic materials suitable for use in rapid processing.

In a preferred embodiment, tabular silver halide grains have an aspect ratio of preferably not lower than 4, but lower than 20, more preferably not lower than 5, but lower than 10. The thickness of the grain is preferably not more than 0.3$\mu$, particularly preferably not more than 0.2$\mu$. The term "aspect ratio of tabular silver halide grain" as used herein refers to a ratio of the mean grain size (the diameter of the grain is defined as the diameter of a circle having an area equal to the projected area of the grain, and the mean grain size is the average of the diameters of the grains) of the grains to the mean value of the thicknesses of the grains.

It is preferred that tabular grains account for at least 80% by weight, more preferably at least 90% by weight of the entire grains in the tabular silver halide emulsion.

When the tabular silver halide emulsion is used, the stability of photographic characteristics in the running processing of the present invention can be further increased. Further, the coating weight of silver can be allowed to be reduced, and hence the loads of the fixing stage and the drying stage in particular can be reduced. Thus, rapid processing can be made.

The tabular silver halide emulsions are described in Cugnac and Chateau, *Evolution of the Morphology of Silver Bromide Crystals During Physical Ripening*, Science et Industrie Photography, Vol. 33, No. 2 (1962), pp. 121–125; Duffin, *Photographic Emulsion Chemistry* (Focal Press, New York 1966), pp. 66–72; and A. P. H. Tribvlli, W. F. Smith, *Photographic Journal*, Vol. 80, p. 285 (1984). The tabular silver halide emulsions can be easily prepared by referring to the methods described in JP-A-58-127921, JP-A-58-113927 and JP-A-58-113928.

Further, the tabular silver halide emulsions can be obtained in the following manner.

Seed crystals wherein tabular grains exist in an amount of at least 40% by weight are formed in a relatively pBr value atmosphere having a pBr value of not higher than 1.3, and the seed crystals are grown while a silver salt solution and a halide solution are simultaneously added under substantially the same pBr value conditions. It is preferred that the silver salt solution and the halide solution are added at such an addition rate that a new crystal nucleus is not formed during the course of the growth of the grains.

The size of the tabular silver halide grains can be controlled by regulating temperature, choosing properly the types and amounts of solvents and controlling the addition rates of the silver salt and the halide used during the course of the growth of the grains.

The silver halide emulsions of the present invention may be polydisperse emulsions or monodisperse emulsions having a uniform grain size distribution. In the case of photographic materials for printing, monodisperse emulsions having a coefficient of dispersion of not higher than 20% in terms of a particle size distribution are preferred. The term "monodisperse emulsion" as used herein refers to a silver halide emulsion having a coefficient of variation of preferably not higher than 20%, particularly preferably not higher than 15% in a grain size distribution.

The coefficient of variation is defined as follows.

Coefficient of variation (%)=(standard deviation of grain size/mean value of grain size)×100

Silver halide grains may be uniform in phase between the interior of the grain and the surface layer thereof or different in phase therebetween. Two or more silver halide emulsions separately prepared may be mixed and used.

Grains wherein a latent image is predominantly formed on the surface of the grain may be used, or grains wherein a latent image is predominantly formed in the interior of the grain may be used. Grains wherein the surfaces thereof are previously fogged may be used.

Cadmium salt, sulfite, lead salt, thallium salt, rhodium salt or complex salt thereof, or iridium salt or complex salt thereof may be allowed to coexist during the formation or physical ripening of silver halide grains in the preparation of the silver halide emulsion of the present invention.

It is preferred that silver halide grains are prepared in the presence of $10^{-8}$ to $10^{-3}$ mol of an iridium salt per mol of silver halide to prepare high-contrast emulsion or to improve reciprocity law failure property in particular.

The silver halide emulsion of the present invention may be an emulsion containing at least one member of rhenium, ruthenium and osmium compounds. The amount of the compound to be added is not more than $10^{-3}$ mol, preferably $10^{-6}$ to $10^{-4}$ mol per mol of silver.

The emulsions of the present invention may be subjected to chemical sensitization or may not be subjected to chemical sensitization. Chemical sensitization methods include conventional methods such as sulfur sensitization, reduction sensitization, selenium sensitization, tellurium sensitization and gold sensitization. These sensitization methods may be used either alone or in combination. Preferred chemical sensitization methods are sulfur sensitization and selenium sensitization.

Examples of sulfur sensitizing agents include sulfur compounds contained in gelatin and various sulfur compounds such as thiosulfates, thioureas, thiazoles and rhodanine. Specific examples thereof are described in U.S. Pat. Nos. 1,574,944, 2,278,947, 2,410,689, 2,728,668, 3,501,313 and 3,656,955. Preferred sulfur compounds are thiosulfates and thiourea compounds. The value of pAg during chemical sensitization is preferably not higher than 8.3, more preferably in the range of 7.3 to 8.0.

A method using polyvinyl pyrrolidone and a thiosulfate in combination, reported by Moisar, *Klin Gelatinone. Proc. Symp.* 2nd, 301 to 309 (1970) gives a favorable result.

Selenium sensitizing agents include active and inactive selenium compounds.

A typical example of noble metal sensitization method is gold sensitization method. In this method, gold compounds, mainly gold complex salts are used. In addition thereto, other noble metals such as complex salts of platinum, palladium and iridium may be used. Specific examples thereof are described in U.S. Pat. No. 2,448,060 and U.K. Patent 618,061.

Reduction sensitizing agents include stannous salts, amines, sulfinoformamidine, dialkylaminoboranes and silane compounds. Specific examples thereof are described in U.S. Pat. Nos. 2,487,850, 2,518,690, 2,983,609, 2,983,610 and 2,694,637.

The emulsion layers of the photographic material of the present invention may contain plasticizers such as polymer latex, for example, alkyl acrylate polymer latex, emulsified products or polyols, for example, trimethylol propane.

The photographic emulsion layers and other hydrophilic colloid layers of the light-sensitive material of the present invention may contain various surfactants as coating aids or to impart antistatic properties, improve slipperiness, facilitate emulsifying dispersion, prevent sticking or improve photographic characteristics (e.g., development acceleration, high-contrast, sensitization).

Examples of the surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, polyethylene oxide adducts of silicone), glycidol derivatives (e.g., alkenylsuccinic acid polyglycerides, alkylphenol glycerides), fatty acid esters of polyhydric alcohols and alkyl esters of sugar; anionic surfactants having an acid group such as carboxyl group, sulfo group, phospho group, sulfuric ester group or phosphoric ester group, such as alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkylphenyl ethers and polyoxyethylenealkylphosphoric esters; ampholyte surfactants such as amino acids, aminoalkylsulfonic acids, aminoalkylsulfuric or phosphoric esters; alkylbetaines and amino oxides; and cationic surfactants such as alkylamine salts, aliphatic or aromatic quaternary ammonium salts, heterocyclic quaternary ammonium salts (e.g., pyridinium, imidazolium) and aliphatic or heterocyclic phosphonium or sulfonium salts.

The silver halide photographic material of the present invention may comprise a support having thereon at least one silver halide emulsion layer. In the case of direct X-ray photographic material for medical use, however, it is preferred that each of both sides of the support is coated with at least one silver halide emulsion layer as described in JP-A-58-127921, JP-A-59-90841, JP-A-58-111934 and JP-A-61-201235.

The photographic material of the present invention may be optionally provided with interlayers, filter layer and antihalation layers.

The photographic material of the present invention is coated with the silver halide emulsion in such an amount as to give a coating weight of preferably 0.5 to 5 g/m$^2$ (per one side), more preferably 1 to 4 g/m$^2$ (per one side) in terms of silver.

It is preferred that the coating weight does not exceed 5 g/m$^2$ for the purpose of rapid processing, and the coating weight is at least 0.5 g/m$^2$ for the purpose of obtaining an image having a given density and a given contrast.

Gelatin can be used as a binder for the silver halide emulsion layers and protective layers of the present invention. However, other hydrophilic colloid can also be used. Examples thereof include protein such as gelatin derivatives, graft polymers of gelatin and other high-molecular materials, albumin and casein; cellulose derivatives such as hydroxyethyl cellulose, carboxymethyl cellulose and cellulose sulfate; sugar derivatives such as sodium alginate and starch derivatives; and various synthetic hydrophilic high-molecular materials such as homopolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinyl pyrazole and copolymers thereof.

Examples of gelatin include lime-processed gelatin, acid-processed gelatin, gelatin hydrolyzate and enzymatic hydrolyzate of gelatin.

In the present invention, it is preferred that the coating weight of gelatin as a binder is as small as possible to provide rapid processability and to improve dimensional stability. Particularly, development rate and fixing rate are greatly affected by the coating weight of gelatin in the protective layer, and drying rate and dimensional stability are influenced by the total coating weight of gelatin use in layers including the protective layer and the silver halide emulsion layers. The coating weight of gelatin in the protective layer of the present invention is not more than 1.5 g/m$^2$, preferably not more than 0.5 g/m$^2$, more preferably 0.15 to 0.5 g/m$^2$. and the total coating weight of gelatin use in all layers including the silver halide emulsion layers on the emulsion layer side of the support is not more than 2.5 g/m$^2$, preferably 1.5 to 2.5 g/m$^2$.

The swelling ratio of the hydrophilic layers including the emulsion layers and protective layers of the silver halide photographic materials of the present invention may be not higher than 150%, particularly preferably 70 to 150%.

When the swelling ratio exceeds 150%, the amount of the silver complex dissolved out from the photographic material into the developing solution is increased and silver stain is increased, while when the swelling ratio is lower than 70%, development rate and fixing rate are retarded and photographic characteristics are adversely affected, though the amount of the silver complex dissolved out is reduced and the property with regard to silver stain is improved.

The swelling ratio of the hydrophilic colloid layer of the present invention can be determined in the following manner. The thickness ($d_0$) of the entire hydrophilic colloid layers including the emulsion layers and protective layers of the silver halide photographic material is measured and the thickness ($\Delta d$) of the swollen entire hydrophilic colloid layers is measured after the silver halide photographic material is immersed in distilled water at 25° C. for one minute. The swelling ratio is calculated from the following formula.

$$\text{Swelling ratio}(\%)=\Delta d \div d_0 \times 100$$

The thickness can be measured by the same theory as that of electric micrometer according to JIS-B7536. For example, the thickness can be measured with electron micrometer (K306 type) manufactured by Anritsu Electric Co., Ltd.

The swelling ratio of the hydrophilic colloid layers including the silver halide emulsion layers and the protective layers can be arbitrarily controlled in the present invention, for example, by using inorganic or organic hardening agents for gelatin, either alone or in a combination of two or more of the hardening agents. Examples of the hardening agents include active vinyl compounds (e.g., 1,3,5-triacyloylhexahydro-s-triazine, bis(vinylsulfonyl)methyl ether, N,N'-methylenebis[β-(vinylsulfonyl)propionamide]), active halogen compounds (e.g., 2,4-dichloro-6-hydroxy-s-triazine), mucohalogenic acids, (e.g., mucochloric acid), N-carbamoylpyridium salts (e.g., 1-morpholicarbonyl-3-pyridinio)methanesulfonate) and haloamidinium salts (e.g., 1-(1-chloro-1-pyridinomethylne)pyrrolidinium 2-naphthalenesulfonate). These compounds may be used singly or in combination. Among them, active vinyl compounds described in JP-A-53-41220, JP-A-53-57257, JP-A-59-162546 and JP-A-60-80846 and active halogen compounds described in U.S. Pat. No. 3,325,287 are preferred.

Typical examples of the hardening agents for gelatin include the following compounds.

H-1

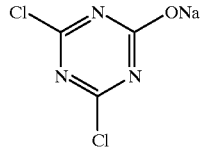

-continued

H-2

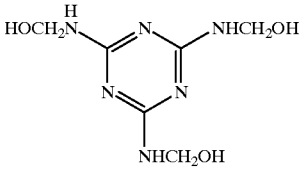

H-3

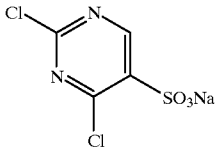

H-4

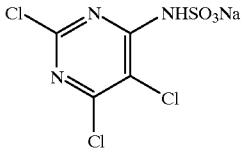

H-5

$CH_2{=}CHSO_2CH_2SO_2CH{=}CH_2$

H-6

$CH_2{=}CHSO_2(CH_2)_2SO_2CH{=}CH_2$

H-7

$CH_2{=}CHSO_2(CH_2)_4SO_2CH{=}CH_2$

H-8

$CH_2{=}CHSO_2CH_2OCH_2SO_2CH{=}CH_2$

H-9

$CH_2{=}CHSO_2(CH_2)_2O(CH_2)_2SO_2CH{=}CH_2$

H-10

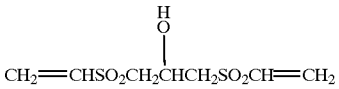

H-11

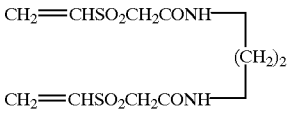

H-12

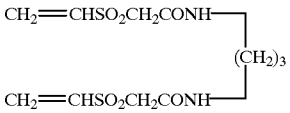

H-13

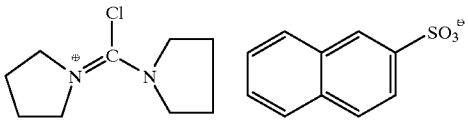

H-14

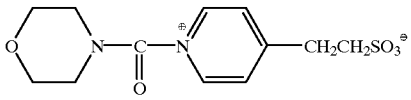

H-15

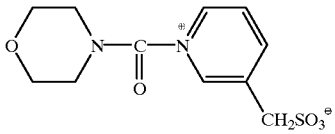

-continued

H-16

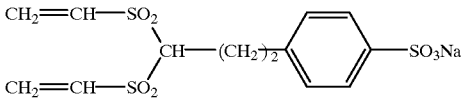

Colloidal silica which can be used in the present invention has an average particle size of 5 to 1000 $\mu$m, preferably 5 to 500 m$\mu$, is mainly composed of silicon dioxide and may contain alumina or sodium aluminate as a minor component. Colloidal silica may contain inorganic bases such as sodium hydroxide, potassium hydroxide, lithium hydroxide and ammonia or organic bases such as tetramethylammonium ion as a stabilizer.

Colloidal silica is-described in more detail in JP-A-51-112732, JP-B-57-9051 and JP-B-57-51653.

Examples of colloidal silica which can be used in the present invention include those which are commercially available from Nissan Chemical Industries Ltd. (Tokyo Japan) under trade names of Snowtex 20 ($SiO_2/Na_2O \geqq 57$), Snowtex 30 ($SiO_2/Na_2O \geqq 50$), Snowtex C ($SiO_2/Na_2O \geqq 100$) and Snowtex O ($SiO_2/Na_2O \geqq 2\ 500$) wherein $SiO_2/N_2O$ is a ratio by weight of silicon dioxide ($SiO_2$) to sodium hydroxide (in terms of $Na_2O$) contained in colloidal silica and each value is cataloged).

The preferred amount of colloidal silica used in the present invention is such that a ratio, on a solid basis, by weight of colloidal silica to gelation used as a binder in the same layer is 0.05 to 1.0:1, particularly preferably 0.1 to 0.5:1.

A kinetic friction coefficient ($\mu_k$) in the present invention can be determined by a theory according to the method for testing kinetic friction coefficient described in JIS-K7125. After a silver halide photographic material is left to stand at 25° C. and 60% RH for at least one hour, a sapphire needle (e.g., 0.5 to 5 mmϕ) is allowed to slide on the surface of the silver halide photographic material at a given speed (e.g., 20 to 100 cm/min) while a given load (contact force: $F_p$, e.g., 50 to 200 g) is applied thereto, and a tangential force ($F_k$) is measured. The kinetic friction coefficient is determined from the following formula.

$$\mu_k = \frac{F_k}{F_p}$$

wherein $\mu_k$ is a kinetic friction coefficient, $F_k$ is a tangential force, and $F_p$ is a contact force.

The kinetic friction coefficient can be measured by a surface profile measuring apparatus (HEIDON-14 type) manufactured by Shinto Kagaku KK.

It is preferred that a lubricant is used to make the kinetic friction coefficient of the outermost layer not higher than 0.35.

Typical examples of the lubricant which can be used in the present invention include silicone lubricants described in U.S. Pat. No. 3,042,522, U.K. Patent 955,061, U.S. Pat. Nos. 3,080,317, 4,004,927, 4,047,958 and 3,489,567 and U.K. Patent 1,143,118; higher aliphatic alcohol or acid amide lubricants described in U.S. Pat. Nos. 2,454,043, 2,732,305, 2,976,148 and 3,206,311, West German Patents 1,284,295 and 1,284,294; metallic soap described in U.K. Patent 1,263,722 and U.S. Pat. No. 3,933,516; ester and ether lubricants described in U.S. Pat. Nos. 2,588,765 and 3,121,060 and U.K. Patent 1,198,387; taurine lubricants described in U.S. Pat. Nos. 3,502,473 and 3,042,222; and the aforesaid colloidal silica.

Alkylpolysiloxanes described in JP-A-60-188945, liquid paraffin which is a liquid at room temperature and anionic surfactants are preferred as the lubricants used in the present invention.

The coating weight of the lubricant is such that a ratio by weight of the lubricant to the amount of the binder used in the outermost layer is 0.01 to 1.0:1, preferably 0.01 to 0.5:1. The coating weight of the lubricant is particularly preferably 0.01 to 0.1 g/m$^2$.

When an anionic surfactant is used, the coating weight thereof is preferably 0.001 to 0.5 g/m$^2$, particularly preferably 0.01 to 0.2 g/m$^2$.

The kinetic friction coefficient ($\mu_K$) is not higher than 0.35, preferably 0.35 to 0.10.

Polyhydroxybenzene compounds described in Japanese Patent Application No. 1-37710 can be used in the present invention to improve pressure resistance without detriment to sensitivity and to improve preservability. The polyhydroxybenzene compounds are added to the emulsion layers or other layers of the photographic material. The effective amounts thereof are in the range of $10^{-5}$ to 1 mol per mol of silver, and the preferred amounts are in the range of $10^{-3}$ to $10^{-1}$ mol per mol of silver.

In the present invention, it is preferred that the protective layer is composed of two or more layers. There is a disadvantage that when the silver halide photographic materials are stored under low humidity conditions, the films of the hydrophilic colloid layers becomes brittle. It is preferred that a polymer latex having a glass transition point (hereinafter referred to as Tg) of not higher than 20° C. is contained in the emulsion layers and/or the protective layers to solve the disadvantage. Particularly, when the protective layers comprise two or more layers, it is preferred from the viewpoint of improving the property with respect to brittleness without detriment to the property with regard to the adhesion of the photographic materials to each other under high humidity conditions that the polymer latex is contained in an interlayer between the emulsion layer and the outermost layer.

It is preferred from the viewpoints of improving slipperiness as well as improving the strength of the dried film and further improving mar resistance that colloidal silica together with the lubricant is contained in the outermost layer. The amount of colloidal silica to be contained in the outermost layer is such that a ratio by weight of the colloidal silica to the amount of the binder in the outermost layer is 0.01 to 1.0:1, preferably 0.1 to 0.5:1.

Examples of the polymer latex to be contained in the protective layers of the present invention are hydrates of vinyl polymers of acrylic esters, methacrylic esters or styrene as described in U.S. Pat. Nos. 2,772,166, 3,325,286, 3,411,911, 3,311,912 and 3,525,620 and *Research Disclosure* No. 195, 19551 (July 1980).

Preferred examples of the polymer latex having a Tg of not higher than 20° C. include homopolymers of alkyl acrylates such as methyl acrylate, ethyl acrylate and butyl acrylate, copolymers of alkyl acrylates with acrylic acid or N-methylol acrylamide (the amount of the comonomer such as acrylic acid being preferably not more than 30% by weight), butadiene homopolymer, copolymers of butadiene with at least one of styrene, butoxymethyl acrylamide and acrylic acid, and vinylidene chloridemethyl acrylate-acrylic acid terpolymer.

Tg of the polymer latex can be determined by using a differential scanning calorimeter (DSC).

The polymer latex of the present invention has an average particle size of preferably 0.005 to 1 $\mu$m, particularly preferably 0.02 to 0.1 $\mu$.

The polymer latex is used in an amount of preferably 5 to 200% by weight, particularly preferably 10 to 100% by weight based on the weight of hydrophilic colloid contained in the layer to which the polymer latex is added.

Specific examples of the polymer latex having a Tg of not higher than 20° C. which can be used in the present invention include, but are not limited to, the latexes of the following compounds.

M-1

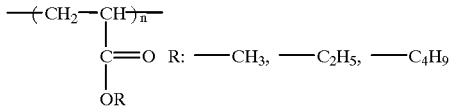

M-2

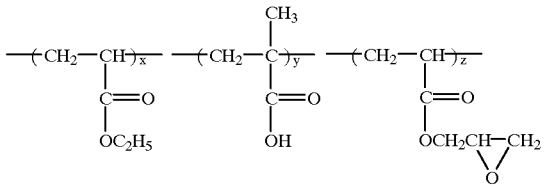

(x/y/z = 93/3/4)

M-3

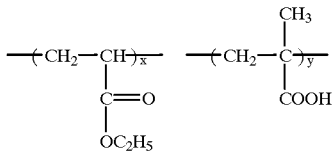

(x/y = 93/7)

M-4

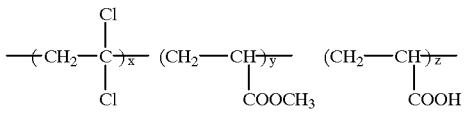

x/y/z = 85/13/2

M-5

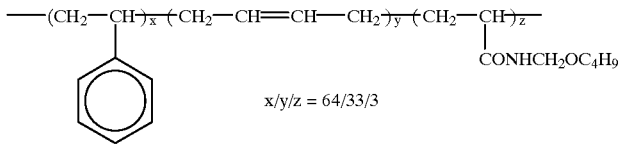

x/y/z = 64/33/3

-continued

M-6

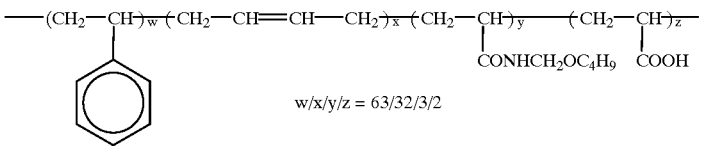

w/x/y/z = 63/32/3/2

M-7

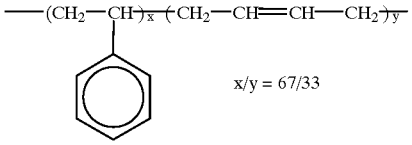

x/y = 67/33

M-8

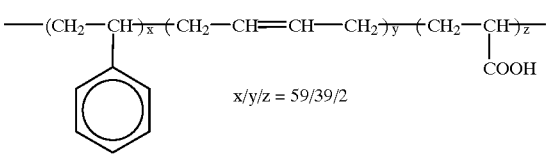

x/y/z = 59/39/2

The light-sensitive materials of the present invention may contain dyes to prevent halation and to improve safety under safelight and the discrimination of the surface and the back.

Examples of such dyes include pyrazolone oxonol dyes described in U.S. Pat. No. 2,274,782, diarylazo dyes described in U.S. Pat. No. 2,956,879, styryl dyes and butadienyl described in U.S. Pat. Nos. 3,423,207 and 3,384,487, merocyanine dyes described in U.S. Pat. No. 2,527,583, merocyanine dyes and oxonol dyes described in U.S. Pat. No. 3,486,897, 3,652,284 and 3,718,472, enaminohemioxonol dyes described in U.S. Pat. No. 3,976,661 and dyes described in U.K. Patents 584,609 and 1,177,429, JP-A-48-85130, JP-A-49-99620, JP-A-49-114420, U.S. Pat. Nos. 2,533,472, 3,148,187, 3,247,127, 3,540,887, 3,575,704 and 3,653,905.

The photographic emulsion layers or other hydrophilic colloid layers of the light-sensitive materials of the present invention may contain various surfactants as coating aids or to impart antistatic properties, improve emulsifying dispersion, prevent sticking and improve photographic characteristics (e.g., development acceleration, high contrast, sensitization).

Examples of the surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, polyethylene oxide adducts of silicones), glycidol derivatives (e.g., alkenylsuccinic acid polyglycerides, alkylphenol polyglycerides), fatty acid esters of polyhydric alcohols and alkyl esters of sugar; anionic surfactants having an acid group such as carboxyl group, sulfo group, phospho group, sulfuric ester group or phosphoric ester group, such as alkylcarboxylates, alkylsulfonates, alkylbenzenesulfonates, alkylnaphthalene sulfonates, alkylsulfuric esters, alkylphosphoric ester, N-acyl-N-alkyltaurines, sulfosuccinic esters, sulfoalkylpolyoxyethylene alkylphenyl ethers and polyoxyethylene alkylphosphoric esters; ampholytic surfactants such as amino acids, aminoalkylsulfonic acids, aminoalkylsulfuric or phosphoric esters, alkylbetaines and amine oxides; and cationic surfactants such as alkylamine salts, aliphatic or aromatic quaternary ammonium salts, heterocyclic quaternary ammonium salts such as pyridinium and imidazolium salts and aliphatic or heterocyclic phosphonium or sulfonium salts.

The photographic emulsion layers and other hydrophilic colloid layers of the photographic materials of the present invention may contain matting agents such as silica, magnesium oxide and polymethyl methacrylate to prevent sticking from being caused.

The light-sensitive materials of the present invention may contain a dispersion of a water-soluble or difficultly water-soluble synthetic polymer to improve dimensional stability. Examples of the polymer include homopolymers of alkyl (meth)acrylates, alkoxyalkyl (meth)acrylates, glycidyl (meth)acrylate, (meth)acrylamide, vinyl esters (e.g., vinyl acetate), acrylonitrile, olefins and styrene, copolymers of two or more of these monomers and copolymers of these monomers with other comonomers such as acrylic acid, methacrylic acid, α,β-unsaturated dicarboxylic acids, hydroxyalkyl (meth)acrylates, sulfoalkyl (meth)acrylates and styrenesulfonic acid.

Examples of supports which can be used for the light-sensitive materials of the present invention include cellulose triacetate, cellulose diacetate, nitrocellulose, polystyrene and polyethylene terephthalate. Among them, polyethylene terephthalate film is most preferred.

These supports may be subjected to a corona discharge treatment in conventional manner, or may be undercoated.

These supports may be provided with waterproof layer containing a polyvinylidene chloride polymer to prevent dimension from being changed by a change in temperature or humidity, that is, to enhance dimensional stability.

In the case of X-ray photographic material, it is particularly preferred that an organic material which flows out in the development stage is contained in the emulsion layers or other hydrophilic colloid layers. When the material which flows out is gelatin, there is preferred a gelatin species which does not participate in the crosslinking reaction of gelatin with a hardening agent. Examples of such gelatin species include acetylated gelatin and phthalated gelatin. A gelatin derivatives having a smaller molecular weight is preferable. In addition to these gelatin derivatives, other high-molecular material can be used. For example, hydrophilic polymers such as polyacrylamide, polyvinyl alcohol and polyvinylpyrrolidone described in U.S. Pat. No. 3,271,158 can be effectively used. Further, saccharide such as dextran, saccharose and pullulan are also effective. Among them, polyacrylamide and dextran are preferred with polyacrylamide being particularly preferred. The materials have an average molecular weight of preferably not more than 20,000, more preferably not more than 10,000. The amount of the outflow thereof is such that at least 10%, but not more than 50% of the total weight of the organic materials coated, excluding silver halide grains, is an effective amount. It is preferred that at least 15%, but not more than 30% is lost.

The layer containing the organic material which flows out in the processing stage may be the emulsion layer or the surface protective layer. However, when the total coating amount of the organic material is the same, the incorporation thereof in both the surface protective layer and the emulsion layer is preferred in comparison with the incorporation thereof in only the emulsion layer, and it is more preferred that the organic material is contained in the surface protective layer alone. In the case of a multi-layer photographic material, it is preferred that a larger amount of the organic material is contained in the emulsion layer nearer to the surface protective layer when the total coating amount of the organic material is the same.

Matting agents which can be used in the present invention include organic compounds such as polymethyl methacrylate homopolymer, copolymer of methyl methacrylate with methacrylic acid and starch and fine particles of inorganic compounds such as silica, titanium dioxide and strontium barium sulfate as described in U.S. Pat. Nos. 2,992,101, 2,701,245, 4,142,894 and 4,396,706. The particle size of the matting agent is preferably 1.0 to 10 $\mu$m, particularly preferably 2 to 5 $\mu$m.

The light-sensitive silver halide emulsions of the present invention may be spectral-sensitized by using spectral sensitizing dyes to a region of a relatively long wavelength, that is, blue light, green light, red light or infrared light. The sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

Useful sensitizing dyes which can be used in the present invention are described in *Research Disclosure*, No. 17643, item IV-A (December 1978, p. 23), ibid. No. 1831, item X (August 1979, p. 437) and in the literature cited therein.

Sensitizing dyes having spectral sensitivity suitable for spectral characteristics of light sources for scanners can be advantageously chosen.

For example, there can be advantageously chosen (A) simple merocyanine dyes described in JP-A-60-162247, JP-A-2-48653, U.S. Pat. No. 2,161,331 and West German Patent 937,071 for argon laser beam source; (B) for helium-neon laser beam source, trinuclear cyan dyes described in JP-A-50-62425, JP-A-54-18726 and JP-A-53-102229; (C) for LED light source, thiacarbocyanines described in JP-A-48-42172, JP-A-51-9609, JP-A-55-39818 and JP-A-62-284343; and (D) for semiconductor light source, tricarbocyanines described in JP-A-59-191032 and JP-A-60-80841 and dicarbocyanines having 4-quinoline nucleus described in JP-A-59-192242.

Typical examples of these sensitizing dyes include the following compounds.

(A) Compounds for argon laser beam source

A-1

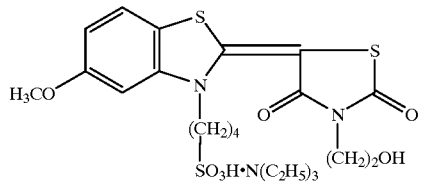

A-2

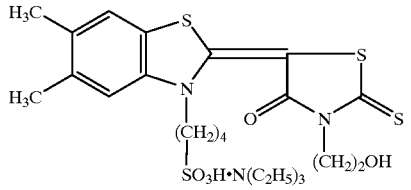

A-3

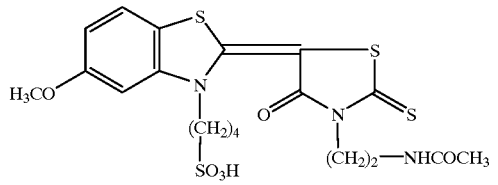

A-4

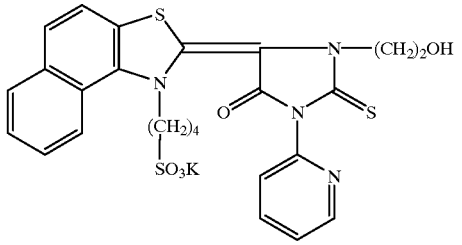

A-5

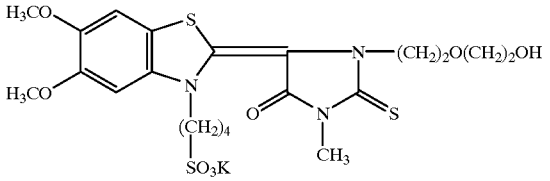

(B) Compounds for He—Ne laser beam source

B-1

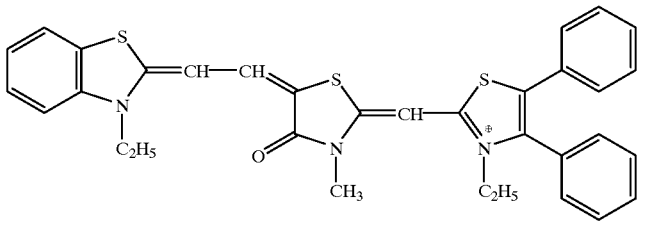

$I^{\ominus}$

-continued
B-2
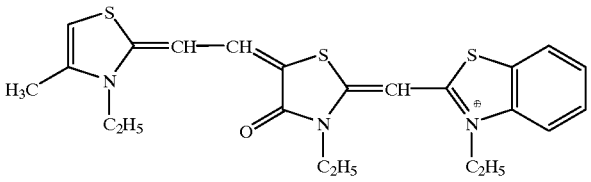
$I^{\ominus}$
B-3
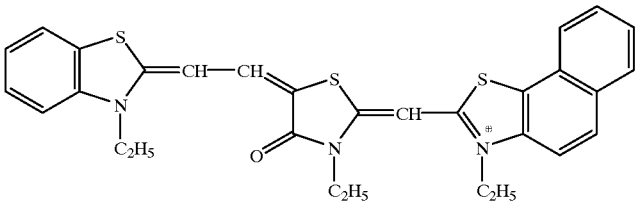
$I^{\ominus}$
B-4
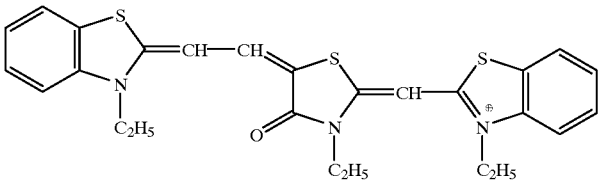
$I^{\ominus}$
B-5
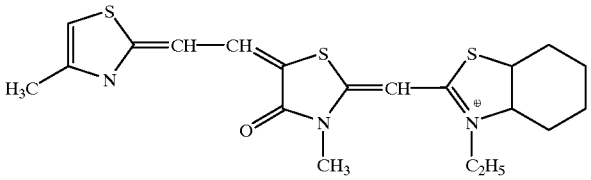
$I^{\ominus}$
B-6
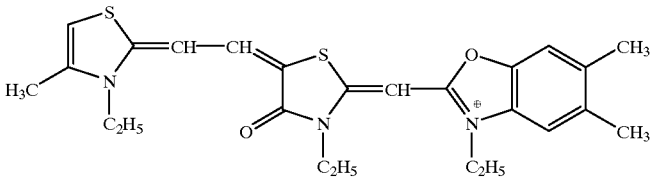
$I^{\ominus}$
B-7
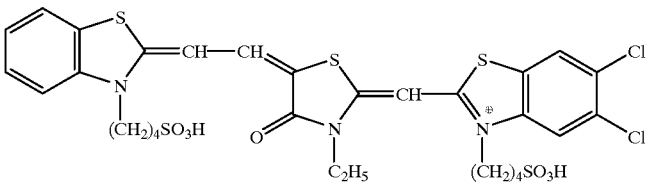
$I^{\ominus}$ -continued
B-8
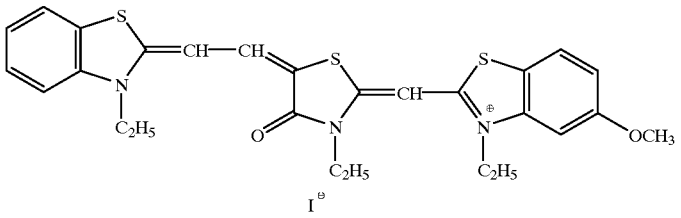
(C) Compounds for LED light source
C-1
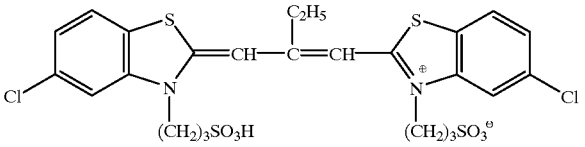
C-2
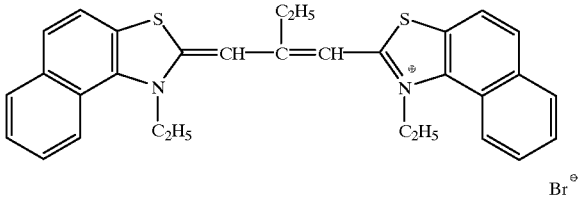
C-3
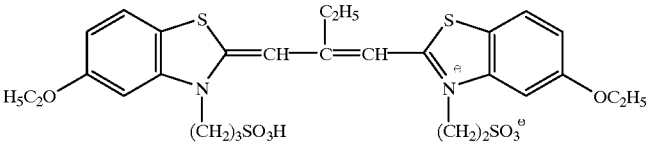
C-4
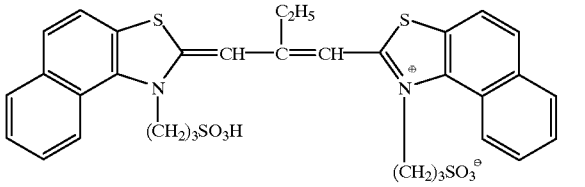
C-5
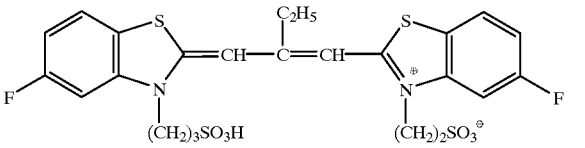
C-6
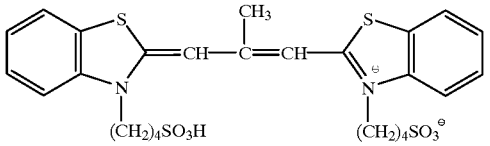
C-7
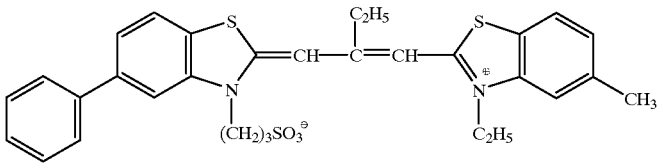

-continued
C-8
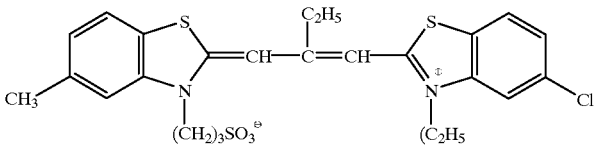
(D) Compounds for semiconductor light source
D-1
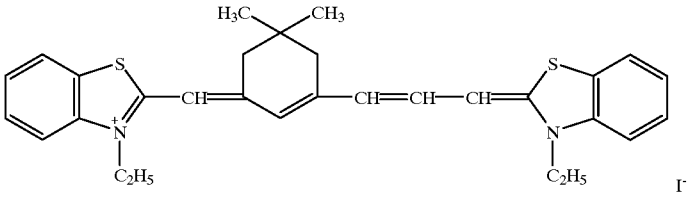
D-2
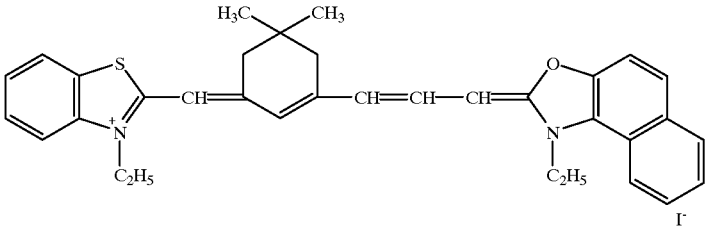
D-3
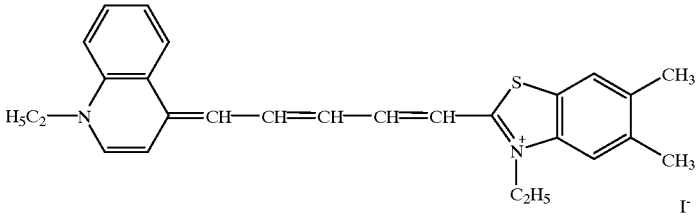
D-4
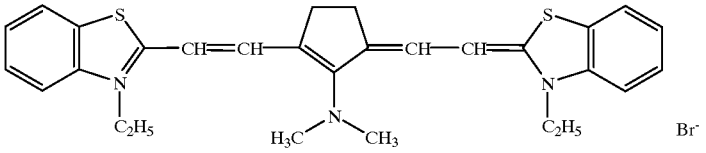
D-5
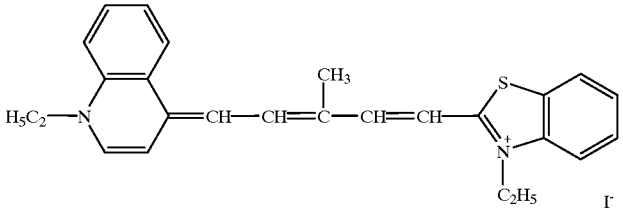

-continued

D-6

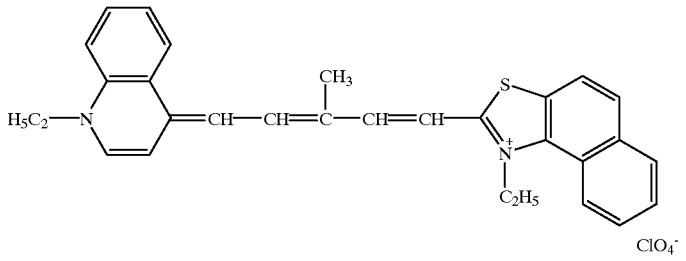

These sensitizing dyes may be used either alone or in combination. A combination of these sensitizing dyes is often used for the purpose of supersensitization. In addition to the sensitizing dyes, the emulsions may contain a dye which itself does not have any spectral sensitization effect or a material which does substantially not absorb visible light, but has a supersensitization effect.

Useful sensitizing dyes, the combinations of dyes having a supersensitization effect and materials having a supersensitization effect are described in *Research Disclosure*, Vol. 176, 17643 (December 1978) page 23, item IV-J.

The hydrophilic colloid layers of the light-sensitive materials of the present invention may contain dyes as filter dyes to prevent irradiation or halation. Particularly preferred water-soluble dyes are compounds represented by the following general formulas (III) to (IX).

(III)

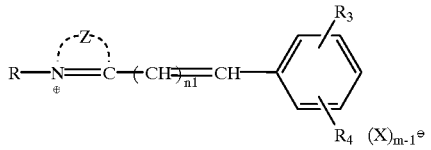

(IV)

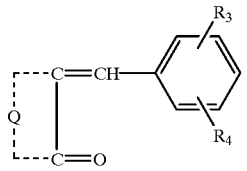

(V)

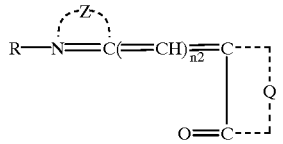

(VI)

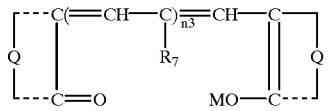

In general formulas (III) to (VII), Z represents a non-metallic atomic group required for forming a benzthiazole, naphthothiazole or benzoxazole heterocyclic nucleus; Q represents an atomic group required for forming pyrazolone, barbituric acid, thiobarbituric acid or 3-oxythionaphthene; R represents a substituted or unsubstituted alkyl group; $R_3$, $R_4$, $R_5$, *and* $R_6$ each represents hydrogen atom, an alkoxy group, a substituted or unsubstituted dialkylamino group or a sulfone group; $R_7$ represents hydrogen atom or a halogen atom; M represents hydrogen atom, sodium atom or potassium atom; X represents an anion; and m, $n_1$, $n_2$ and $n_3$ each represents 0, 1 or 2. When m is 1, the compounds form an inner salt.

(VII)

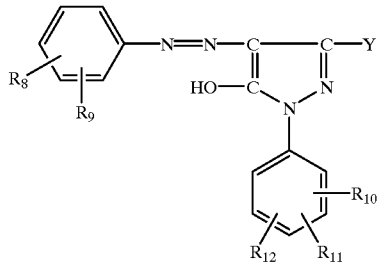

wherein Y represents an alkyl group or carboxyl group; $R_8$, $R_9$, $R_{10}$, $R_{11}$ and $R_{12}$ each represents hydrogen atom, chlorine atom, a substituted or unsubstituted alkyl group, a substituted or unsubstituted alkoxy group, a substituted or unsubstituted amino group, a substituted or unsubstituted acylamino group, carboxyl group, hydroxyl group or a sulfone group.

(VIII)

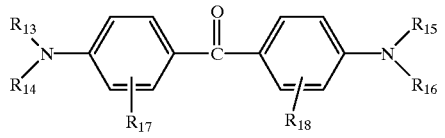

wherein $R_{13}$, $R_{14}$, R15, and $R_{16}$ represents an alkyl group, a hydroxyalkyl group, cyano group, an alkylcyano group, an alkoxy group or a sulfoalkyl group; and $R_{17}$ and $R_{18}$ each represents sulfo group or a sulfoalkyl group.

(IX)

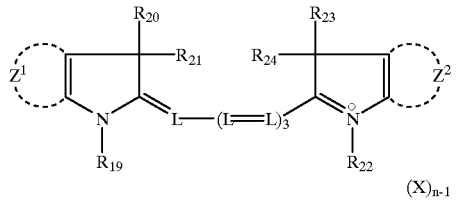

wherein $R_{19}$, $R_{20}$, $R_{21}$, $R_{22}$, $R_{23}$ and $R_{24}$ may be the same or different and each represents a substituted or unsubstituted alkyl group; $Z^1$ and $Z^2$ each represents a non-metallic atomic group required for forming a substituted or unsubstituted benzo-condensed ring or naphthocondensed ring; at least one of $R_{19}$, $R_{20}$, $R_{21}$, $R_{22}$, $R_{23}$, $R_{24}$, $Z^1$ and $Z^2$ is a group having an acid group as a substituted group; L represents a substituted or unsubstituted methine group; X represents an anion; n represents 1 or 2; and when the dye forms an inner salt, n is 1.

Useful examples of the compounds which can be used in the present invention include the following compounds.

E-1

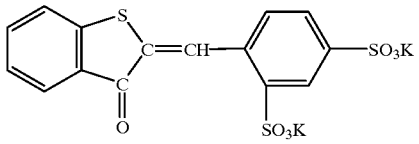

E-2

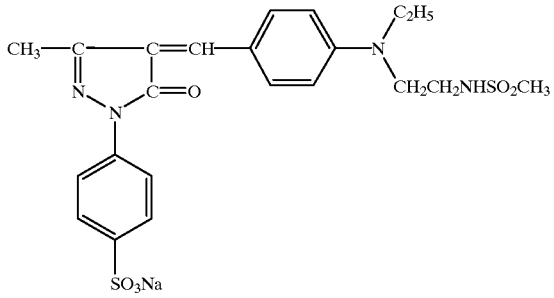

E-3

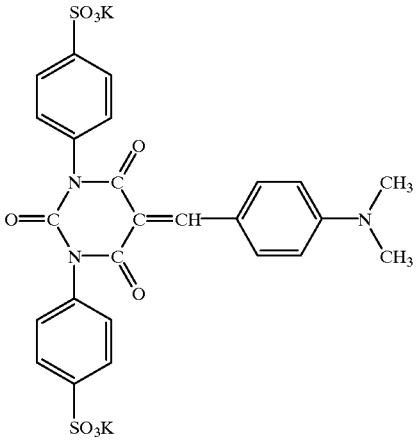

E-4

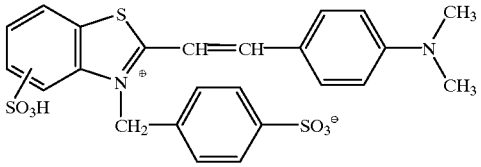

E-5

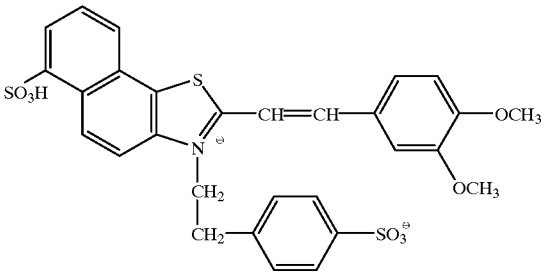

E-6

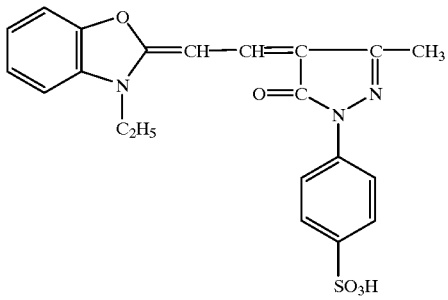

E-7

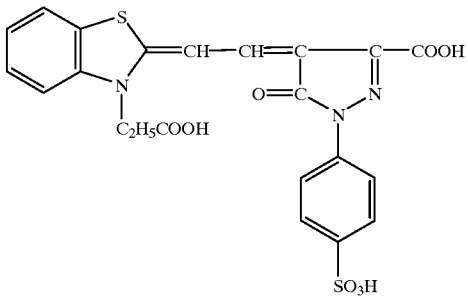

-continued
E-8
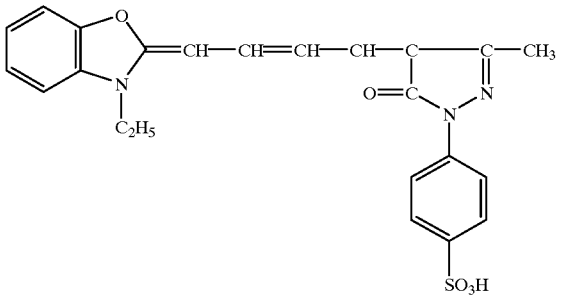
E-9
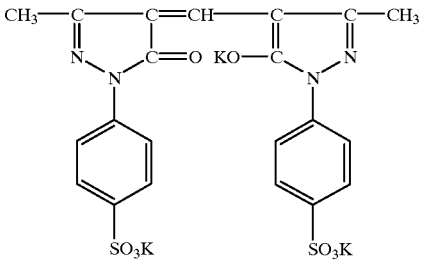
E-10
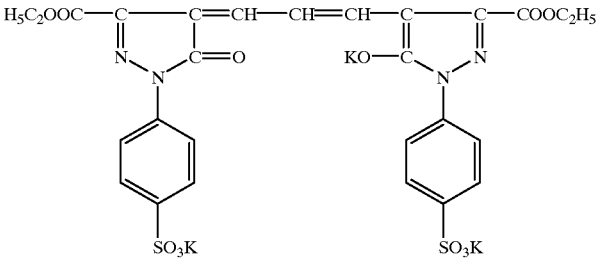
E-11
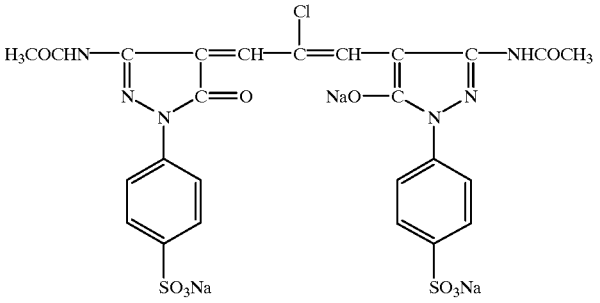
E-12
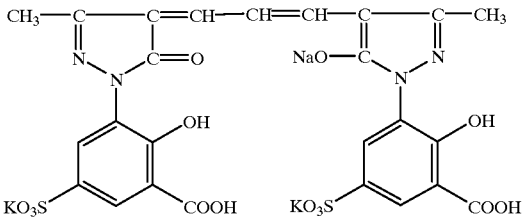

-continued
E-13
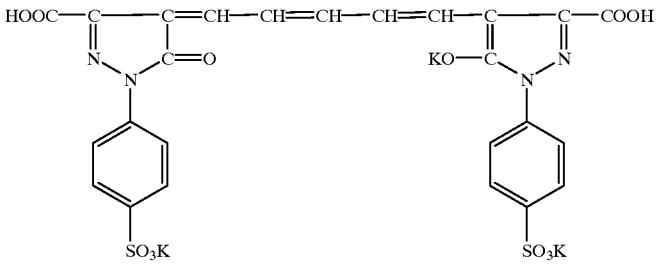
E-14
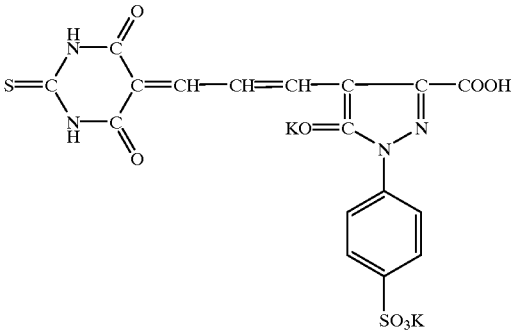
E-15
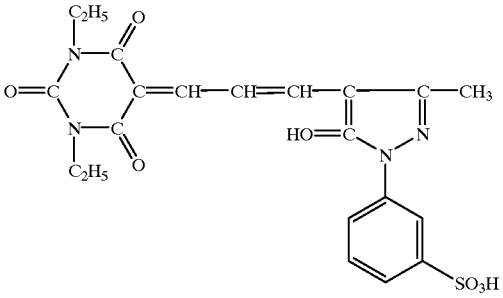
E-16
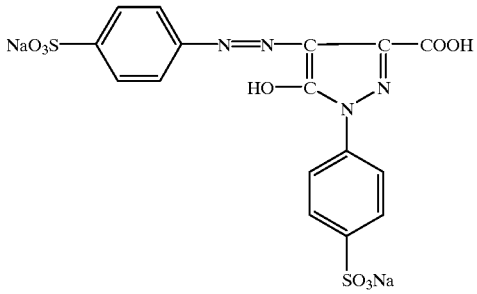
E-16
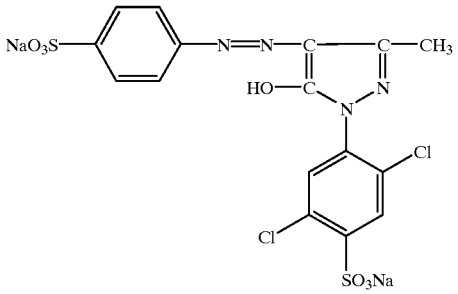
E-18
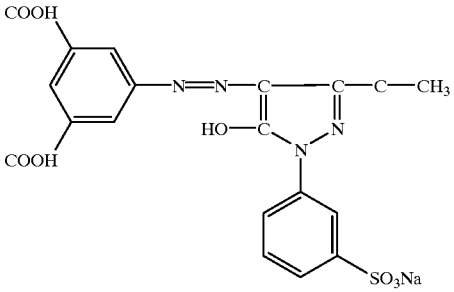
E-19
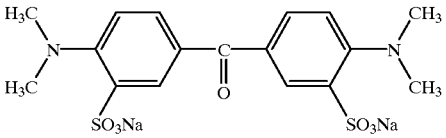
E-20
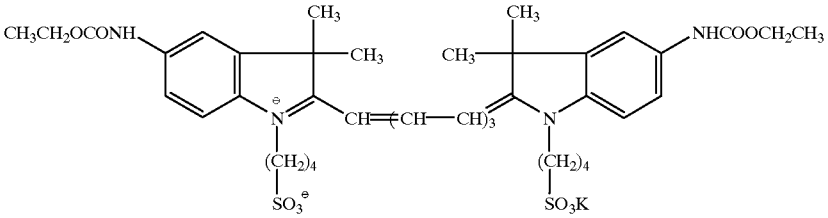

-continued

E-21

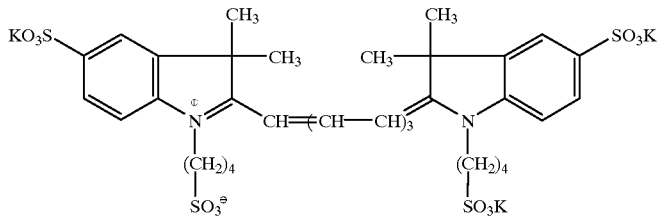

When these dyes are used, it is an effective technique that an anionic dye is mordanted into a specific layer by using a polymer having a cation site. In this case, it is preferred that there is used a dye which is irreversibly decolorized in the development-fixing-rinsing stage. The layer into which the dye is introduced by using a polymer having a cation site may be between the emulsion layers or the surface protective layers or may be provided on the opposite side of the support to the emulsion layers. It is preferred that the layer is provided between the emulsion layer and the support. For the purpose of cross-over cut for X-ray double-coated films for medical use in particulars it is ideal that the dye is introduced into an undercoat layer.

Polyethylene oxide nonionic surfactants as coating aids for the undercoat layer can be preferably used in combination with the polymer having a cation site.

Preferred examples of the polymer which provides a cation side include anion exchange polymers.

The anion exchange polymers which can be used in the present invention include conventional quaternary ammonium salt (or phosphonium salt) polymers. The quaternary ammonium salt (or phosphonium salt) polymers are widely known as mordant polymers and antistatic polymers and described in many publications mentioned below.

Specific examples thereof include water dispersed latexes described in JP-A-59-166940, U.S. Pat. No. 3,958,995, JP-A-55-142339, JP-A-54-126027, JP-A-54-155835, JP-A-53-30328 and JP-A-54-92274; polyvinyl pyridinium salts described in U.S. Pat. No. 2,548,564, 3,148,061 and 3,756,814; water-soluble quaternary ammonium salt polymers described in U.S. Pat. No. 3,709,690; and water-insoluble quaternary ammonium salt polymers described in U.S. Pat. No. 3,898,088.

Aqueous latexes of polymers obtained by co-polymerizing monomers having at least two (preferably two to four) ethylenically unsaturated groups and crosslinking the resulting copolymer are particularly preferred because there is no possibility that such polymers migrate from a desired layer into other layer or the processing solutions and have photographically an adverse effect.

As a method for fixing the dyes, a solid dispersion method described in JP-A-55-155350 and WO 88/04794 is effective.

The photographic material of the present invention may be prepared by using a hydrazine nucleating agent so as to give superhigh contrast photographic characteristics. This system is particularly suitable for graphic arts. Examples of the system and the hydrazine nucleating agent are described in *Research Disclosure*, Item 23516 (p. 346 November 1983) and the literature cited therein, U.S. Pat. Nos. 4,080,207, 4,269,929, 4,276,364, 4,278,748, 4,385,108, 4,459,347, 4,560,638 and 4,478,928, U.K. Patent 2,011,391B, JP-A-60-179734, JP-A-62-270946, JP-A-63-29751, JP-A-61-170733, JP-A-61-270744, JP-A-62-948, EP 217,310, JP-A-63-32538, JP-A-63-104047, JP-A-63-121838, JP-A-63-129337, JP-A-63-234245, JP-A-63-234246, JP-A-63-223744, JP-A-63-294552, JP-A-63-306438, JP-A-64-10233, U.S. Pat. No. 4,686,167, JP-A-62-178246, JP-A-63-234244, JP-A-64-90438, JP-A-1-276128, JP-A-1-283548, JP-A-1-280747, JP-A-1-283549, JP-A-1-285940, JP-A-2-2541, JP-A-2-139538, JP-A-2-177057, JP-A-2-198440, JP-A-2-198441, JP-A-2-198442, JP-A-2-196234, JP-A-2-196235, JP-A-2-220042, JP-A-2-221953 and JP-A-2-221954.

It is preferred that the hydrazine nucleating agents are contained in the silver halide emulsion layers of the photographic material. However, the hydrazine nucleating agents may be contained in other non-sensitive hydrophilic colloid layers (e.g., protective layer, interlayer, filter layer, antihalation layer). The hydrazine nucleating agents are used in the range of preferably $1\times10^{-6}$ to $5\times10^{-2}$ mol, particularly preferably $1\times10^{-5}$ to $2\times10^{-2}$ mol per mol of silver halide.

Development accelerators or accelerators for nucleating infectious development which are suitable for use in the superhigh contrast system include compounds described in JP-A-53-77616, JP-A-54-37732, JP-A-53-137133, JP-A-60-140340 and JP-A-60-14959 and various compounds having N or S atom.

The optimum amounts of these accelerators to be added vary depending on the types of the compounds, but they are used in the range of generally $1.0\times10^{-3}$ to 0.5 g/m$^2$, preferably $5.0\times10^{-3}$ to 0.1 g/m$^2$.

In the superhigh contrast system, redox compounds which release a restrainer can be used together with the above compounds. Examples of the redox compounds include compounds described in JP-A-2-293736, JP-A-2-308239, JP-A-1-154060 and JP-A-1-205885. The redox compounds are used in the range of preferably $1\times10^{-6}$ to $1\times10^{-2}$ mol, particularly preferably $1\times10^{-5}$ to $1\times10^{-2}$ mol per mol of silver halide.

The photographic materials of the present invention may contain various compounds to prevent fogging from being caused during the course of the preparation, storage or processing of the photographic materials or the stabilize photographic performance. Examples of the compounds known as anti-fogging agents or stabilizers include azoles such as benzthiazolium salts, nitroindazoles, chlorobenzimidazoles, bromobezimidazoles, mercaptotetrazoles, mercaptothiazoles, mercaptobenzthiazoles, mercaptothiadiazoles, aminotriazoles, benzthiazoles and nitrobenztriazoles; mercaptotriazines; thioketo compounds such as oxazolinethione; azaindenes such as triazaindenes, tetrazaindenes (e.g., 4-hydroxy-substituted (1,3,3a,7)tetrazaindenes), pentazaindenes; and benzenethiosulfonic acid, benzenesulfinic acid and benzenesulfonic aid amide. Among them, benztriazoles (e.g., 5-methylbenztriazole) and nitroindazoles (e.g., 5-nitroindazole) are preferred. These compounds may be contained in the processing solutions. Further, the photographic materials of the present invention may contain compounds which release a restrainer during development as described in JP-A-62-30243 as stabilizers or to prevent black pepper from being formed.

The photographic materials of the present invention may contain developing agents such as hydroquinone derivatives and phenidone derivatives for various purpose of stabilizers, accelerators.

The photographic emulsion layers and other hydrophilic colloid layers of the photographic materials of the present invention may contain inorganic or organic hardening agents. Examples of the hardening agents include chromium salts (e.g., chromium alum, chromium acetate), aldehydes (e.g., formaldehyde, glutaraldehyde), N-methylol compounds (e.g., dimethylol urea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogenic acids (e.g., mucochloric acid). These compounds may be used either alone or in combination.

The photographic emulsion layers and other hydrophilic colloid layers of the photographic materials of the present invention may contain hydroquinone derivatives (so-called DIR hydroquinone) which release a restrainer corresponding to the density of an image during development.

Specific examples thereof include compounds described in U.S. Pat. Nos. 3,379,529, 3,620,746, 4,377,634 and 4,332,878, JP-A-49-129536, JP-A-54-67419, JP-A-56-153336, JP-A-56-153342, JP-A-59-278853, JP-A-59-90435, JP-A-59-90436 and JP-A-59-138808.

The light-sensitive materials of the present invention may contain a dispersion of a water-insoluble or difficultly soluble synthetic polymer. Examples of the polymer include homopolymers or copolymers of alkyl (meth)acrylates, alkoxyalkyl (meth)acrylates and glycidyl (meth)acrylate and copolymers of these monomers with acrylic acid or methacrylic acid.

It is preferred that the silver halide emulsion layers and other layers of the light-sensitive materials of the present invention contain a compound having an acid group. Examples of the compound having an acid group include organic acids such as salicylic acid, acetic acid and ascorbic acid and polymers and copolymers having a repeating unit derived from an acid monomer such as acrylic acid, maleic acid or phthalic acid. With regard to these compounds, references can be made to the specifications of JP-A-61-223834, JP-A-61-228437, JP-A-62-25745 and JP-A-62-55642. Among them, there are particularly preferred ascorbic acid as the low-molecular compound and water-dispersible latexes of copolymers obtained from an acid monomer such as acrylic acid and a crosslinking monomer having at least two unsaturated groups such as vinylbenzene as high-molecular compounds.

The thus-prepared silver halide emulsions are coated on a support such as cellulose acetate film or polyethylene terephthalate film by means of dip coating, air knife coating, bead coating, extrusion coating, doctor knife coating or double side coating, and then dried.

A water-impermeable reflection support is used as the support of the present invention. In the case of photographic paper which requires long-time rinsing, such as photographic paper comprising baryta paper, residual color is almost decolorized by rinsing over a long period of time even when residual color, which is a problem to be solved by the present invention, is left behind after processing. Accordingly, there is a difficulty in expecting the effect of the present invention. Typical examples of the water-impermeable reflection support include polyolefin-laminated paper supports. Particularly, supports wherein the laminate layer on the image side thereof contains a white pigment are most widely used. In addition thereto, there can be used film supports whose reflectance is increased by incorporating a white pigment therein.

It is preferred that the light-sensitive materials of the present invention contain sulfonated stilbene, coumarin or thiophene fluorescent brighteners described in U.S. Pat. No. 2,933,390, JP-B-48-30495 and JP-A-55-135833 or the emulsified dispersions or latex dispersions of water-insoluble fluorescent brighteners described in JP-A-60-136737.

The present invention can also be applied to color light-sensitive materials. Various color couplers can be used. The term "color coupler" as used herein refers to a compound which is coupled with the oxidant of an aromatic primary amine developing agent to form a dye. Typical examples of useful color couplers include naphthol or phenol compounds, pyrazolone or pyrazoloazole compounds and ring-open or heterocyclic ketomethylene compounds. Concrete examples of cyan, magenta and yellow couplers which can be used in the present invention are described in patent specifications cited in *Research Disclosure* (RD) 17643 (December 1978), item VII-D and ibid. 18717 (November 1979).

Various photographic additives which can be used in the present invention are also described in, for example, the aforesaid *Research Disclosure* No. 17643, pages 23–28 and *Research Disclosure* No. 18716, pages 648–651.

The types of these additives and the places of the disclosures thereof are indicated below.

| Additive | RD 17643 | RD 18716 |
|---|---|---|
| 1. Chemical Sensitizing Agent | Page 23 | Right column of page 648 |
| 2. Sensitivity Increaser | | Right column of page 648 |
| 3. Spectral Sensitizing Agent, Supersensitizing Agent | Pages 23 to 24 | Right column of page 648 to right column of page 649 |
| 4. Brightening Agent | Page 24 | |
| 5. Anti-fogging Agent, Stabilizer | Pages 24 to 25 | Right column of page 649 |
| 6. Light-Absorber, Filter Dye, Ultraviolet Absorber | Pages 25 to 26 | Right column of page 649 to left column of page 650 |
| 7. Antistaining Agent | Right column of page 25 | Left column to right column of page 650 |
| 8. Dye Image Stabilizer | Page 25 | |
| 9. Hardening Agent | Page 26 | Left column of page 651 |
| 10. Binder | Page 26 | Left column of page 651 |

The light-sensitive materials of the present invention exhibit an excellent performance particularly in rapid processing using automatic processors wherein the total processing time is from 15 to 60 seconds and the line speed is from 1500 to 5000 mm/min.

Furthermore, the light-sensitive materials of the present invention exhibit an excellent performance particularly in rapid processing using automatic processors wherein the replenishment rate of the developing solution and/or the fixing solution are from 50 to 200 ml per $m^2$ of silver halide photographic material in a system wherein the silver halide photographic material after exposure is subjected to at least development, fixing and rinsing.

The present invention is now illustrated in greater detail by reference to the following examples which, however, are not to be construed as limiting the present invention in any way.

EXAMPLE A-1

Preparation of Emulsion:

Preparation of Emulsion A

| Solution 1 | |
|---|---|
| Water | 1.0 l |
| Gelatin | 20 g |
| Sodium chloride | 20 g |
| 1,3-Dimethylimidazolidine-2-thione | 20 mg |
| Sodium benzenethiosulfonate | 8 mg |
| **Solution 2** | |
| Water | 400 ml |
| Silver nitrate | 100 g |
| **Solution 3** | |
| Water | 400 ml |
| Sodium chloride | 27.1 g |
| Potassium bromide | 21 g |
| Potassium hexachloroiridate(III) (0.001% agueous solution) | 15 ml |
| Ammonium hexabromorhodate(III) (0.001% aqueous solution) | 1.5 ml |

To the solution 1 kept at 38° C. and at a pH of 4.5 with stirring, there were simultaneously added the solution 2 and the solution 3 over a period of 10 minutes to form nucleus grains of 0.16 μm. Subsequently, the following solutions 4 and 5 were added thereto over a period of 10 minutes. Further, 0.15 g of potassium iodide was added thereto to complete the formation of nucleus grains.

| Solution 4 | |
|---|---|
| Water | 400 ml |
| Silver nitrate | 100 g |
| **Solution 5** | |
| Water | 400 ml |
| Sodium chloride | 27.1 g |
| Potassium bromide | 21 g |
| Potassium hexacyanoferrate(III) (0.1% agueous solution) | 5 ml |

Subsequently, water washing was carried out by conventional flocculation method, and 30 g of gelatin was added.

The pH of the resulting emulsion was adjusted to 5.3, and pAg was adjusted to 7.5. Subsequently, 2.6 mg of sodium thiosulfate, 1.0 mg of N,N-dimethylselenourea and 6.2 mg of chloroauric acid were added thereto, and further 4 mg of sodium benzenethiosulfonate and 1 mg of sodium benzene sulfinate were added. Chemical sensitization was carried out at 55° C. so as to give the optimum sensitivity.

Thereafter, 200 mg of 4-hydroxy-6-methyl-1,3,3a,7-tetrazaindene as a stabilizer and phenoxy-ethanol as an antiseptic agent were added thereto. There was finally obtained a silver iodochlorobromide cubic grain emulsion having a silver chloride content of 70 mol % and a mean grain size of 0.2 μm (a coefficient of variation: 9%).

Preparation of Coated Sample

To the thus-obtained emulsion, there was added orthosensitizing dye (the following compound) in an amount of $5\times10^{-4}$ mol/mol of Ag. Further, 2.5 g (per mol of Ag) of hydroquinone and 50 mg (per mol of Ag) of 1-phenyl-5-mercaptotetrazole as anti-fogging agents, polyethyl acrylate latex, as a plasticizer, in an amount of 25% based on the amount of gelatin binder and 2-bis-(vinylsulfonylacetamido) ethane as a hardening agent were added thereto. Furthermore, colloidal silica in an amount of 40% based on the amount of gelatin binder was added thereto. The resulting emulsion was coated on a polyester support in such an amount as to give a coating weight of 3.0 g/m² in terms of Ag and a coating weight of 1.0 g/m² of gelatin. The following lower protective layer and upper protective layer were simultaneously coated on the emulsion layer.

Orthosensitizing dye

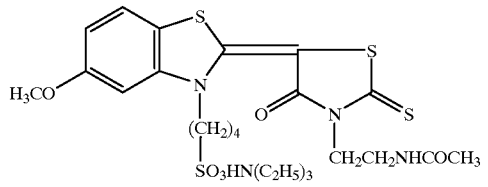

| Lower protective layer | |
|---|---|
| Gelatin | 0.25 g/m² |
| Sodium benzenethiosulfonate | 4 mg/m² |
| 1,5-Dihydroxy-2-benzaldoxime | 25 mg/m² |
| Polyethyl acrylate latex | 125 mg/m² |
| **Upper protective layer** | |
| Gelatin | 0.25 g/m² |
| Matting agent (silica having an average particle size of 2.5 μm) | 50 mg/m² |
| Compound (1) (gelatin dispersion) | 30 mg/m² |
| Colloidal silica having a particle size of 10 to 20 μm | 30 mg/m² |
| Compound (2) | 5 mg/m² |
| Sodium dodecylbenzenesulfonate | 22 mg/m² |

Compound (1)

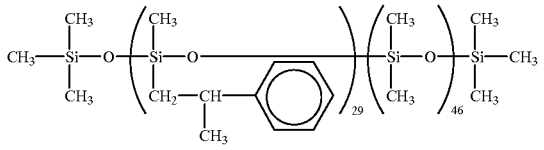

Compound (2)

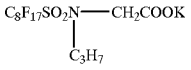

The base used in this Example had the following back layer and back protective layer, each layer having the following composition.

| Back layer | |
|---|---|
| Sodium dodecylbenzenesulfonate | 80 mg/m² |
| Compound (3) | 70 mg/m² |
| Compound (4) | 85 mg/m² |
| Compound (5) | 90 mg/m² |
| 1,3-Divinylsulfone-2-propanol | 60 mg/m² |

-continued

Compound (3)

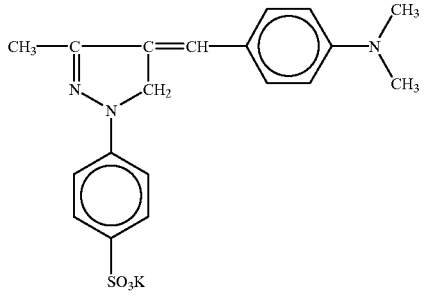

Compound (4)

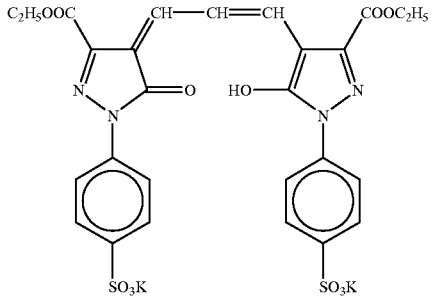

Compound (5)

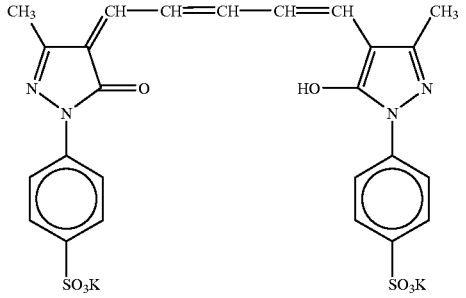

Back protective layer

| | |
|---|---|
| Gelatin | 0.5 g/m$^2$ |
| Polymethyl methacrylate (particle size: 4.7 $\mu$m) | 30 mg/m$^2$ |
| Sodium dodecylbenzenesulfonate | 20 mg/m$^2$ |
| The above-described compound (2) | 2 mg/m$^2$ |
| The above-described compound (1) (gelatin dispersion) | 100 mg/m$^2$ |

A developing solution have the following composition was prepared.

| | |
|---|---|
| Sodium 1,2-dihydrdoxxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenztriazole | 0.2 g |

-continued

| | |
|---|---|
| Hydroquinone | 30.0 g |
| 4-Hydroxymethyl-4-methyl-1-phenyl-3-pyrazolidone | 1.6 g |
| Add water to make | 1 liter |

Postassium hydroxide was added to adjust pH to 10.7.

The developing solution was referred to as base, and testing developing solutions indicated in Table A-1 were prepared.

TABLE A-1

| Developing solution No. | Compound of formula (I) Compound No. | Compound of formula (I) Amount added | Compound of formula (II) Compound No. | Compound of formula (II) Amount added |
|---|---|---|---|---|
| 1 Comp. EX. | — | — | — | — |
| 2 Comp. EX. | I-4 | 0.18 g/l | — | — |
| 3 Comp. EX. | — | — | II-7 | 0.30 g/l |
| 4 Invention | I-4 | 0.18 g/l | II-7 | 0.30 g/l |
| 5 Invention | I-4 | 0.04 g/l | II-7 | 0.30 g/l |
| 6 Invention | I-6 | 0.30 g/l | II-4 | 0.28 g/l |
| 7 Invention | I-6 | 0.30 g/l | II-7 | 0.30 g/l |
| 8 Invention | I-7 | 0.32 g/l | II-4 | 0.28 g/l |
| 9 Invention | I-7 | 0.32 g/l | II-7 | 0.30 g/l |

The resulting samples were exposed to light through an interference filter having a peak at 488 nm and a continuous wedge by using a xenon lamp (emission time: $10^{-6}$ sec). Sensitometry was carried out under the following temperature and time conditions by using an automatic processor FG-710NH manufactured by Fuji Photo Film Co., Ltd. and running experiment was carried out.

| | | |
|---|---|---|
| Development | 38° C. | 14 sec |
| Fixing | 37° C. | 9.7 sec |
| Rinsing | 26° C. | 9 sec |
| Squeeze | | 2.4 sec |
| Drying | 55° C. | 8.3 sec |
| Total | | 43.4 sec |

Running was made under such running conditions that 200 films of Daizenshi size (50.8 cm×61.0 cm) which were half-exposed were processed for one day, this processing was continuously carried out for 3 days, and the processing was then suspended for 4 days (silver stain easily occurred during the suspension for 4 days in comparison with the case where the processing was carried out, and the degree of deterioration was about three times higher than that of usual running). This running was referred to as the first round. Five rounds in total was carried out. The replenishment rate was 50 ml per one film of 50.8 cm×61.0 cm size.

The usual running refers to such running that processing is conducted for 6 days and suspended for one day.

The fixing solution used was LF-308 manufactured by Fuji Photo Film Co., Ltd., and the replenishment rate was 100 ml per one film.

The results of photographic characteristics and silver stain obtained by the running experiments are shown in Table A-2.

TABLE A-2

| Test No. | Photographic characteristics | Fresh solution | Last | Occurrence of silver stain in developing solution | Staining of light-sensitive material |
|---|---|---|---|---|---|
| 1 Comp. EX. | fog | 0.04 | 0.04 | occurred on the second day of the first round | occurred on the 7th day of the second round |
| | gradation | 6.00 | 6.05 | | |
| | sensitivity | 100 | 98 | | |
| 2 Comp. EX. | fog | 0.04 | 0.04 | occurred on the first day of the third round | occurred on the third day of the 5th round |
| | gradation | 5.70 | 5.75 | | |
| | sensitivity | 98 | 95 | | |
| 3 Comp. EX. | fog | 0.04 | 0.04 | occurred on the 6th day of the first round | occurred on the first day of the 4th round |
| | gradation | 5.80 | 5.83 | | |
| | sensitivity | 98 | 96 | | |
| 4 Invention | fog | 0.04 | 0.04 | not occurred until the 5th round was ended | not occurred |
| | gradation | 5.82 | 5.86 | | |
| | sensitivity | 97 | 97 | | |
| 5 Invention | fog | 0.04 | 0.04 | slightly occurred on the third day of the 5th round | not occurred |
| | gradation | 5.98 | 5.97 | | |
| | sensitivity | 99 | 98 | | |
| 6 Invention | fog | 0.04 | 0.04 | slightly occurred on the 7th day of the 5th round | not occurred |
| | gradation | 6.00 | 6.01 | | |
| | sensitivity | 100 | 98 | | |
| 7 Invention | fog | 0.04 | 0.04 | not occurred until the 5th round was ended | not occurred |
| | gradation | 5.94 | 5.90 | | |
| | sensitivity | 99 | 99 | | |
| 8 Invention | fog | 0.04 | 0.04 | slightly occurred on the 7th day of the 5th round | not occurred |
| | gradation | 5.90 | 5.91 | | |
| | sensitivity | 101 | 99 | | |
| 9 Invention | fog | 0.04 | 0.04 | not occurred until the 5th round was ended | not occurred |
| | gradation | 5.92 | 5.93 | | |
| | sensitivity | 98 | 98 | | |

The evaluation of the photographic characteristics was made in the following manner. Gradation is a value obtained by dividing a difference between a density of 3.0 and a density of 0.1 by a difference between the logarithm of an exposure amount giving a density of 3.0 and the logarithm of an exposure amount giving a density of 0.1. The reciprocal of an exposure amount giving a density of 1.5 is referred to herein as sensitivity. The sensitivity in terms of the relative sensitivity is shown in Table when the sensitivity of the photographic material processed with the fresh solution of the developing solution No. 1 is referred to as 100.

It can be seen from Table A-2 that with regard to the change of the photographic characteristics, there is substantially little difference between the developing solution containing the compound of the present invention and the developing solution containing comparative compound. With regard to silver stain, comparative developing solution Nos. 1 and 3 cause the occurrence of silver stain during processing in the first round and the developing solution No. 3 causes silver stain in the third round, while the developing solution Nos. 5, 6 and 8 containing the compounds of the present invention slightly cause silver stain in the fifth round and the developing solution Nos. 4, 7 and 9 do not cause silver stain. With regard to the staining of the photographic material, the deposition of silver stain on the photographic material is observed in Comparative Examples, while the deposition of silver stain is not observed when the compounds of the present invention are used.

EXAMPLE A-2

First Light-sensitive Emulsion Layer

Preparation of Light-sensitive Emulsion A

An aqueous solution of 0.37 M silver nitrate and an aqueous halide solution containing $1\times10^{-7}$ mol (per mol of silver) of $(NH_4)_3RhCl_6$, $5\times10^{-7}$ mol (per mol of silver) of $K_3IrCl_6$, 0.11 M potassium bromide and 0.27 M sodium chloride were added to an aqueous gelatin solution containing 1,3-dimethyl-2-imidazolinethione with stirring at 45° C. over a period of 12 minutes by means of the double jet process to obtain silver chlorobromide grains having a mean grain size of 0.20 μm and a silver chloride content of 70 mol %, whereby nucleation was made. Subsequently, an aqueous solution of 0.63 M silver nitrate and an aqueous halide solution containing 0.19 M potassium bromide and 0.47 M sodium chloride were added thereto over a period of 20 minutes by means of the double jet process. Thereafter, a solution of $1\times10^{-3}$ mol of KI was added thereto, conversion was made, and the resulting emulsion was washed with water by conventional flocculation method. Subsequently, 40 g of gelatin was added thereto, pH was adjusted to 6.5 and pAg was adjusted to 7.5. Further, 5 mg of sodium thiosulfate, 8 mg of chloroauric acid and 7 mg of sodium benzenethiosulfonate were added thereto, each amount being per mol of silver. The emulsion was heated at 60° C. for 45 minutes to carry out chemical sensitization. Further, 150 mg of 4-hydroxy-6-methyl-1,3,3a,7-tetrazaindene as a stabilizer, Proxel and phenoxyethanol were added thereto. The resulting grains were silver chlorobromide cubic grains having a mean grain size of 0.28 μm and a silver chloride content of 70 mol % (a coefficient of variation: 9%).

Coating of First light-sensitive Emulsion Layer

Each of these emulsions was divided, and $1\times10^{-3}$ mol (per mol of silver) of potassium salt of 5-[3-(4-sulfobutyl)-5-chloro-2-benzoxazolidilidene]-1-hydroxy-ethyl-3-(2-pyridyl)-2-thiohydantoin as a sensitizing dye was added to each portion. Further, $2\times10^{-4}$ mol of 1-phenyl-5-mercaptotetrazole, $5\times10^{-4}$ mol of short-wave cyanine dye [the following compound (a)], a polymer [the following compound (b)] (200 mg/m$^2$), hydroquinone (50 mg/m$^2$), a dispersion of polyethyl acrylate (200 mg/m$^2$), 1,3-bisvinylsulfonyl-2-propanol (200 mg/m$^2$) as a hardening agent and the following hydrazine compound (c) were added thereto. The emulsion was coated in such an amount as to give a coating weight of 3.6 g/m$^2$ in terms of silver and a coating weight of 2.0 g/m$^2$ of gelatin.

Compound (a)

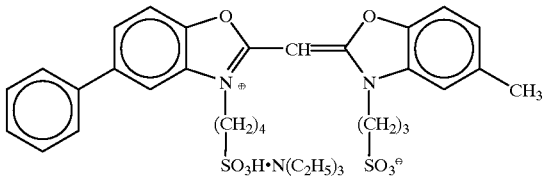

Compound (b)

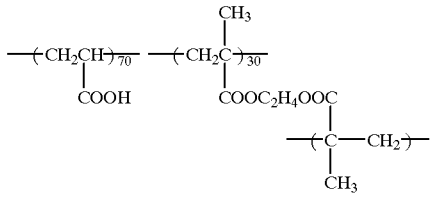

Hydrazine Compound (c)

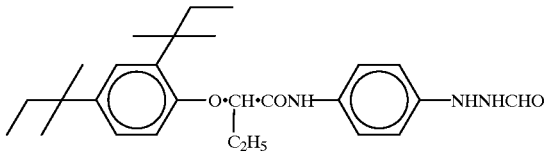

$2.8 \times 10^{-5}$ mol/m$^2$

| Coating of interlayer | |
|---|---|
| Gelatin | 1.0 g/m$^2$ |
| 1,3-Bisvinylsulfonyl-2-propanol | 4.0 wt % based on the amount of gelatin |

Second Light-sensitive Emulsion Layer

Preparation of Light-sensitive Emulsion B

An aqueous solution of 1.0 M silver nitrate and an aqueous halide solution containing $3\times10^{-7}$ mol (per mol of silver) of $(NH_4)_3RhCl_6$, 0.3 M potassium bromide and 0.74 M sodium chloride were added to an aqueous gelatin solution containing sodium chloride and 1,3-dimethyl-2-imidazolidinethione with stirring at 45° C. over a period of 30 minutes by means of the double jet process to obtain silver chlorobromide grains having a mean grain size of 0.28 μm and a silver chloride content of 70 mol %. The resulting emulsion was washed with water by conventional flocculation method, 40 g of gelatin was added thereto, pH was adjusted to 6.5 and pAg was adjusted to 7.5. Further, 5 mg of sodium thiosulfate and 8 mg of chloroauric acid were added thereto, each amount being per mol of silver. The emulsion was heated at 60° C. for 60 minutes to carry out chemical sensitization. Subsequently, 150 mg of 4-hydroxy-6-methyl-1,3,3a,7-tetrazaindene as a stabilizing agent was added thereto. The resulting grains were silver chlorobromide cubic grains having a mean grain size of 0.28 μm and a silver chloride content of 70 mol % (a coefficient of variation: 10%).

Coating of Second Light-sensitive Emulsion Layer

The light-sensitive emulsion B was re-dissolved, and $1.0\times10^{-3}$ mol of potassium salt of 5-[3-(4-sulfo-butyl)-5-chloro-2-benzoxazolidilidene]-1-hydroxyethyl-3-(2-pyridyl)-2-thiohydantoin as a sensitizing dye and $1.0\times10^{-3}$ mol of KI solution were added thereto, each amount being per mol of silver. Further, $2\times10^{-4}$ mol of 1-phenyl-5-mercaptotetrazole, a dispersion of polyethyl acrylate (50 mg/m$^2$), 4.0 wt % (based on the amount of gelatin) of 1,3-bisvinylsulfonyl-2-propanol as a hardening agent and the following redox compound ($1.0\times10^{-4}$ mol/m$^2$) were added thereto. The resulting emulsion was coated in such an amount as to give a coating weight of 0.2 g/m$^2$ in terms of gelatin and a coating weight of 0.3 g/m$^2$ of gelatin.

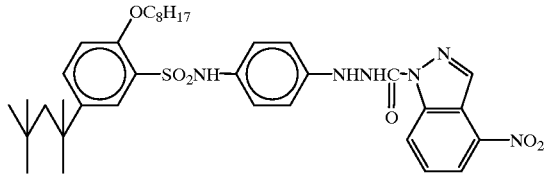

Coating of Protective Layer

A protective layer comprising gelatin (1.0 g/m$^2$) and polymethyl methacrylate particles having an average particle size of 2.5μ (0.3 g/mm$^2$) was coated thereon by using the following surfactants.

| Surfactant | |
|---|---|
| 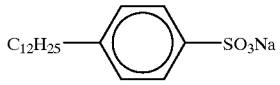 | 37 mg/m$^2$ |
| $CH_2COOC_6H_{13}$ / $CHCOOC_6H_{13}$ / $SO_3Na$ | 37 mg/m$^2$ |
| $C_8F_{17}SO_2N(C_3H_7)CH_2COOK$ | 2.5 mg/m$^2$ |

A back layer having the following formulation and a back protective layer having the following formulation were coated.

| Back layer | |
|---|---|
| Gelatin | 3 mg/m$^2$ |
| Polyethyl acrylate latex | 2 g/m$^2$ |
| Surfactant (sodium p-dodecylbenzenesulfonate) | 40 mg/m$^2$ |
| Hardening agent for gelatin | 110 mg/m$^2$ |

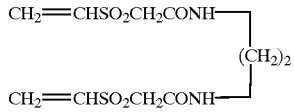

Dye: a mixture of dyes [a], [b] and [c]

| | |
|---|---|
| Dye [a] | 50 mg/m$^2$ |
| Dye [b] | 100 mg/m$^2$ |
| Dye [c] | 50 mg/m$^2$ |

-continued

Dye [a]

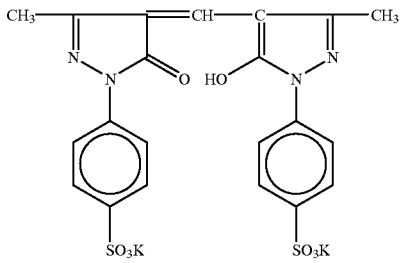

Dye [b]

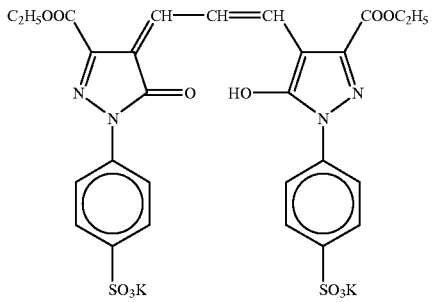

Dye [c]

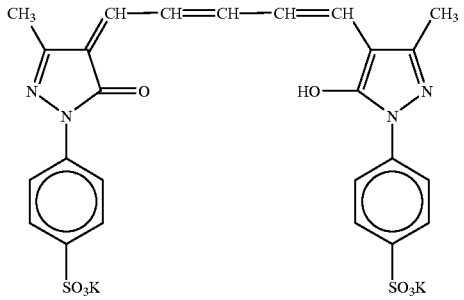

Back protective layer

| | |
|---|---|
| Gelatin | 0.8 g/m$^2$ |
| Polymethyl methacrylate fine particles (average particle size: 4.5$\mu$) | 30 mg/m$^2$ |
| Dihexyl sodium α-sulfosuccinate | 15 mg/m$^2$ |
| Sodium dodecylbenzenesulfonate | 15 mg/m$^2$ |
| Sodium acetate | 40 mg/m$^2$ |
| Fluorine-containing surfactant | 5 mg/m$^2$ |

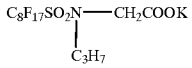

The first light-sensitive emulsion layer as the lowermost layer was coated on a polyester film (100$\mu$ thick) support. Further, the second light-sensitive emulsion layer containing the redox compound through the interlayer and the protective layer were simultaneously coated thereon to prepare a sample.

A developing solution having the following composition was prepared.

| | |
|---|---|
| Hydroquinone | 50.0 g |
| N-Methyl-p-aminophenol | 0.3 |
| Sodium hydroxide | 18.0 |
| 5-Sulfosalicylic acid | 55.0 |
| Potassium sulfite | 124.0 |
| Disodium ethylenediaminetetraacetate | 1.0 |
| Potassium bromide | 10.0 |
| 5-Methylbenztriazole | 0.4 |
| Sodium 3-(5-mercaptotetrazole)-benzenesulfonate | 0.2 |
| N-n-Butylethanolamine | 15.0 |
| Sodium toluenesulfonate | 8.0 |
| Add water to make | 1 liter |

Potassium hydroxide was added thereto to adjust pH to 11.6.

This developing solution was referred to as a base, and testing developing solutions indicated in Table A-3 were prepared.

TABLE A-3

| Developing solution No. | Compound of formula (I) | | Compound of formula (II) | |
|---|---|---|---|---|
| | Compound No. | Amount added | Compound No. | Amount added |
| 1 Comp. EX | — | — | — | — |
| 2 Comp. EX | I-3 | 0.16 g/l | — | — |
| 3 Comp. EX | — | — | II-7 | 0.30 g/l |
| 4 Invention | I-3 | 0.16 g/l | II-7 | 0.30 g/l |
| 5 Invention | I-3 | 0.04 g/l | II-7 | 0.30 g/l |
| 6 Invention | I-4 | 0.18 g/l | II-4 | 0.28 g/l |
| 7 Invention | I-4 | 0.18 g/l | II-7 | 0.30 g/l |
| 8 Invention | I-7 | 0.32 g/l | II-4 | 0.28 g/l |
| 9 Invention | I-7 | 0.32 g/l | II-7 | 0.30 g/l |

The resulting film samples were exposed to tungsten light (3200° K) through an optical wedge and processed in an automatic processor FG-710 manufactured by Fuji Photo Film Co., Ltd. Development was carried out at 34° C. for 30 seconds. Running experiment was made in the same manner as in Example A-1 except that the replenishment rate of the developing solution was 75 ml per one film of Daizenshi size (50.8 cm×60.1 cm).

The fixing solution used was GR-F1 manufactured by Fuji Photo Film Co., Ltd., and the replenishment rate thereof was 100 ml per one film of 50.8 cm×60.1 cm size.

The results of running experiment using these developing solutions and samples are shown in Table A-4. Similar results to those of Example A-1 could be obtained.

It can be seen from Table A-4 that when the compounds of the present invention are used, silver stain can be greatly reduced without an adverse effect on photographic characteristics.

TABLE A-4

| Test No. | Photographic characteristics | Fresh solution | Last | Occurrence of silver stain in developing solution | Staining of light-sensitive material |
|---|---|---|---|---|---|
| 1 Comp. EX. | fog<br>gradation<br>sensitivity | 0.04<br>18.00<br>100 | 0.04<br>16.05<br>90 | occurred on the first day of the first round | occurred on the 7th day of the second round |
| 2 Comp. EX. | fog<br>gradation<br>sensitivity | 0.04<br>18.50<br>98 | 0.04<br>16.45<br>89 | occurred on the first day of the third round | occurred on the second day of the 5th round |
| 3 Comp. EX. | fog<br>gradation<br>sensitivity | 0.04<br>17.95<br>98 | 0.04<br>15.81<br>88 | occurred on the first day of the first round | occurred on the second day of the 4th round |
| 4 Invention | fog<br>gradation<br>sensitivity | 0.04<br>17.92<br>100 | 0.04<br>15.88<br>87 | not occurred until the 5th round was ended | not occurred |
| 5 Invention | fog<br>gradation<br>sensitivity | 0.04<br>18.28<br>99 | 0.04<br>16.00<br>88 | slightly occurred on the second day of the 5th round | not occurred |
| 6 Invention | fog<br>gradation<br>sensitivity | 0.04<br>18.02<br>100 | 0.04<br>16.01<br>91 | slightly occurred on the 4th day of the 5th round | not occurred |
| 7 Invention | fog<br>gradation<br>sensitivity | 0.04<br>17.98<br>99 | 0.04<br>15.92<br>90 | not occurred until the 5th round was ended | not occurred |
| 8 Invention | fog<br>gradation<br>sensitivity | 0.04<br>18.10<br>101 | 0.04<br>16.12<br>89 | slightly occurred on the 5th day of the 5th round | not occurred |
| 9 Invention | fog<br>gradation<br>sensitivity | 0.04<br>18.11<br>98 | 0.04<br>16.22<br>88 | not occurred until the 5th round was ended | not occurred |

EXAMPLE A-3

(1) Preparation of Silver Halide Emulsion

In one liter of $H_2O$ was dissolved 40 g of gelatin, and 6 g of sodium chloride, 0.4 g of potassium bromide and 60 mg of the following compound [I]

Compound [I]

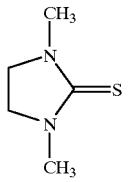

were placed in a container heated to 53° C. Subsequently, 600 ml of an aqueous solution containing 100 g of silver nitrate and 600 ml of an aqueous solution containing 56 g of potassium bromide and 7 g of sodium chloride were added thereto by means of the double jet process to form a core having a silver chloride content of 20 mol %. Thereafter, 500 ml of an aqueous solution containing 100 g of silver nitrate and 500 ml of an aqueous solution containing 40 g of potassium bromide, 14 g of sodium chloride and $10^{-7}$ mol (per mol of silver) of potassium hexachloroiridate(III) were added thereto by means of the double jet process to form a shell having a silver chloride content of 40%, thus preparing core/shell type monodisperse cubic silver chlorobromide grains having a mean grain size of 0.35 $\mu$m.

After the resulting emulsion was desalted, 40 g of gelatin was added thereto, the pH of the emulsion was adjusted to 6.0 and the pAg thereof was adjusted to 8.5. Subsequently, 2 mg of triethylthiourea, 4 mg of chloroauric acid and 0.2 g of 4-hydroxy-6-methyl-1,3,3a,7-tetrazaindene were added thereto, and chemical sensitization was carried out at 60° C.

(2) Preparation of Emulsion Coating Solution 850 g of the emulsion was placed in a container which was then heated to 40° C. The following additives were added thereto to prepare an emulsion coating solution.

Formulation A of emulsion coating solution

| | | |
|---|---|---|
| a | Emulsion | 850 g |
| b | Spectral sensitizing dye [II] | $1.2 \times 10^{-4}$ mol |
| c | Supersensitizing dye [III] | $0.8 \times 10^{-3}$ mol |
| d | Preservability improver [IV] | $1 \times 10^{-3}$ mol |
| e | Polyacrylamide (mol. wt. 40,000) | 7.5 g |
| f | Trimethylol propane | 1.6 g |
| g | Polystyrenesulfonic acid (Na salt) | 2.4 g |
| h | Latex of poly(ethyl acrylate/methacrylic acid) | 16 g |
| i | N,N'-Ethylenebis(vinylsulfonacetamide) | 1.2 g |

-continued

| Formulation A of emulsion coating solution |
|---|

Spectral sensitizing dye [II]

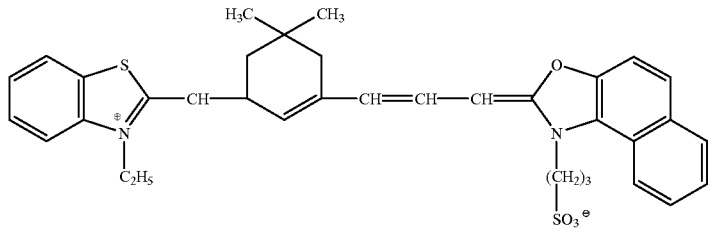

Supersensitizing dye [III]

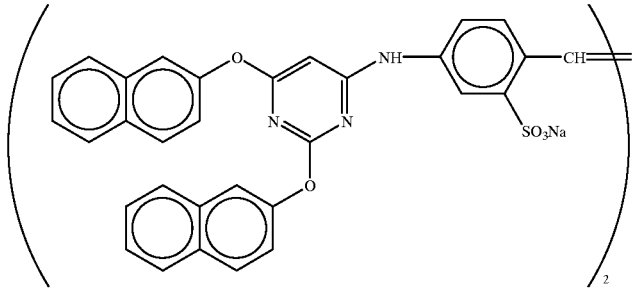

Preservability improver [IV]

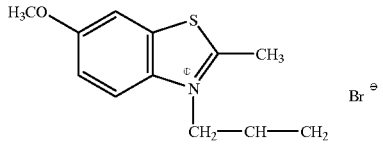

(3) Preparation of Coating Solution for Surface Protective Layer of Emulsion Layer A container was heated to 40° C. and the following additives were added thereto to prepare a coating solution.

| Formulation of coating solution for surface protective layer of emulsion layer | |
|---|---|
| a Gelatin | 100 g |
| b Polyacrylamide (Mol. Wt. 40,000) | 10 g |
| c Polysodium styrenesulfonate (Mol. Wt. 600,000) | 0.6 g |
| d N,N'-Ethylenebis(vinylsulfonacetamide) | 1.5 g |
| e Polymethyl methacrylate fine particles (average particle size: 2.0 μm) | 2.2 g |

-continued

| Formulation of coating solution for surface protective layer of emulsion layer | |
|---|---|
| f Sodium t-octylphenoxyethoxyethanesulfonate | 1.2 g |
| g $C_{16}H_{33}O—(CH_2CH_2O)_{10}—H$ | 2.7 g |
| h Polysodium acrylate | 4 g |
| i $C_8F_{17}SO_3K$ | 70 mg |
| j $C_8F_{17}SO_2N(C_3H_7)(CH_2CH_2O)_4(CH_2)_4—SO_3Na$ | 70 mg |
| k NaOH (1N) | 4 ml |
| l Methanol | 60 ml |

(4) Preparation of Coating Solution for Back Layer

A container was heated to 40° C. and the following additives were added thereto to prepare a coating solution for back layer.

| Formulation of coating solution for back layer | | |
|---|---|---|
| a | Gelatin | 80 g |
| b | Dye [V] | 3.1 g |
| c | Polysodium styrenesulfonate | 0.6 g |
| d | Poly(ethyl acrylate/methacrylic acid) latex | 15 g |
| e | N,N'-Ethylenebis(vinylsulfonacetamide) | 4.3 g |

-continued

| Formulation of coating solution for back layer |
|---|
| Dye [V] |

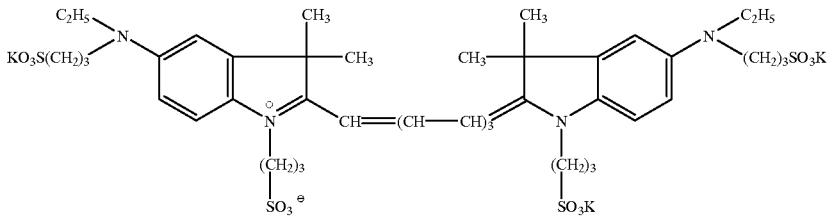

(5) Preparation of Coating Solution for Surface Protective Layer for Back

A container was heated to 40° C. and the following additives were added thereto to prepare a coating solution.

| Formulation of coating solution for surface protective layer for back | |
|---|---|
| a Gelatin | 80 g |
| b Polysodium styrenesulfonate | 0.3 g |
| c N,N'-Ethylenebis(vinylsulfonacetamide) | 1.7 g |
| d Polymethyl methacrylate fine particles (average particle size: 4.0 μm) | 4.0 g |
| e Sodium t-octylphenoxyethoxyethanesulfonate | 3.6 g |
| f NaOH (1 N) | 6 ml |
| g Polysodium acrylate | 2 g |
| h $C_{16}H_{33}O—(CH_2CH_2O)_{10}—H$ | 3.6 g |
| i $C_8F_{17}SO_3K$ | 50 mg |
| j $C_8F_{17}SO_2N(C_3H_7)(CH_2CH_2O)_4(CH_2)_4—SO_3Na$ | 50 mg |
| k Methanol | 130 ml |

(6) Preparation of Coated Sample

The coating solution for back layer and the coating solution for surface protective layer for back layer were coated on a polyethylene terephthalate support in such an amount that the total coating weight of gelatin was 3 g/m$^2$. Subsequently, the coating solution for emulsion layer and the coating solution for surface protective layer were coated on the opposite side of the support to the back layer in such an amount that the coating weight of the emulsion layer was 2.5 g/m$^2$ in terms of silver and the gelatin coating weight of the surface protective layer was 1 g/m$^2$.

A concentrated developing solution having the following formulation was prepared.

| Concentrated developing solution (2.5 fold concentrate) | |
|---|---|
| Potassium hydroxide | 43 g |
| Sodium sulfite | 100 g |
| Potassium sulfite | 126 g |
| Diethylenetriaminepentaacetic acid | 5 g |
| Boric acid | 20 g |
| Hydroquinone | 85 g |
| 4-Hydroxymethyl-4-methyl-1-phenyl-3-pyrazolidone | 15 g |
| Diethylene glycol | 30 g |
| 3-Methylbenztriazole | 0.2 g |
| Potassium bromide | 10 g |

The concentrated developing solution is diluted with water to a volume of one liter (pH is adjusted to 10.65).

The above concentrated solution was diluted in the following manner to obtain a working solution.

Concentrated developing solution (400 ml) + water (600 ml) = working solution (pH was adjusted to 10.35).

The developing solution was referred to as a base, and developing solutions indicated in Table A-5 were prepared.

TABLE A-5

| Developing solution No. | Compound of formula (I) Compound No. | Compound of formula (I) Amount added | Compound of formula (II) Compound No. | Compound of formula (II) Amount added |
|---|---|---|---|---|
| 1 Comp. EX. | — | — | — | — |
| 2 Comp. EX. | I-3 | 0.16 g/l | — | — |
| 3 Comp. EX. | — | — | II-7 | 0.30 g/l |
| 4 Invention | I-3 | 0.16 g/l | II-7 | 0.30 g/l |
| 5 Invention | I-3 | 0.04 g/l | II-7 | 0.30 g/l |
| 6 Invention | I-4 | 0.18 g/l | II-4 | 0.28 g/l |
| 7 Invention | I-4 | 0.18 g/l | II-7 | 0.30 g/l |
| 8 Invention | I-7 | 0.32 g/l | II-4 | 0.28 g/l |
| 9 Invention | I-7 | 0.32 g/l | II-7 | 0.30 g/l |

A roller conveying type automatic processor FPM-2000 (manufactured by Fuji Photo Film Co., Ltd.) was modified so that 30 second's processing (dry to dry) could be carried out. The coated samples were subjected to the same running test as in Example A-1. The fixing solution used was RF-10 manufactured by Fuji Photo Film Co., Ltd. The replenishment rate of each of the developing solution and the fixing solution was 20 ml per 10×12 in.

In the test method of photographic characteristics, the coated samples were left to stand for 7 days, while keeping the temperature and the humidity at 25° C. and 60%, after coating, and scanning exposure for $10^{-7}$ sec was carried out at room temperature by using semiconductor laser of 780 nm.

The results of the running test are shown in Table A-6. It can be seen from Table that when the compounds of the present invention are used, silver stain can be greatly reduced without an adverse effect on photographic characteristics as in Examples A-1 and A-2.

TABLE A-6

| Test No. | Photographic characteristics | Fresh solution | Last | Occurrence of silver stain in developing solution | Staining of light-sensitive material |
|---|---|---|---|---|---|
| 1 | fog | 0.04 | 0.04 | occurred on the second | occurred on the |
| Comp. EX | gradation | 2.75 | 2.74 | day of the first round | 7th day of the |
| | sensitivity | 100 | 99 | | second round |
| 2 | fog | 0.04 | 0.04 | occurred on the first | occurred on the |
| Comp. EX | gradation | 2.70 | 2.71 | day of the third round | third day of the |
| | sensitivity | 98 | 99 | | 5th round |
| 3 | fog | 0.04 | 0.04 | occurred on the first | occurred on the |
| Comp. EX | gradation | 2.71 | 2.71 | day of the second round | first day of the |
| | sensitivity | 98 | 96 | | 4th round |
| 4 | fog | 0.04 | 0.04 | not occurred until the | not occurred |
| Invention | gradation | 2.70 | 2.72 | 5th round was ended | |
| | sensitivity | 100 | 97 | | |
| 5 | fog | 0.04 | 0.04 | slightly occurred on | not occurred |
| Invention | gradation | 2.71 | 2.72 | the 4th day of the 5th | |
| | sensitivity | 99 | 98 | round | |
| 6 | fog | 0.04 | 0.04 | slightly occurred on | not occurred |
| Invention | gradation | 2.74 | 2.75 | the 5th day of the 5th | |
| | sensitivity | 100 | 100 | round | |
| 7 | fog | 0.04 | 0.04 | not occurred until the | not occurred |
| Invention | gradation | 2.75 | 2.75 | 5th round was ended | |
| | sensitivity | 99 | 99 | | |
| 8 | fog | 0.04 | 0.04 | slightly occurred on | not occurred |
| Invention | gradation | 2.76 | 2.74 | the third day of the | |
| | sensitivity | 101 | 99 | 5th round | |
| 9 | fog | 0.04 | 0.04 | not occurred until the | not occurred |
| Invention | gradation | 2.73 | 2.75 | 5th round was ended | |
| | sensitivity | 98 | 100 | | |

EXAMPLE A-4

An aqueous solution of one kg of $AgNO_3$ and an aqueous solution containing 161 g of KBr and 205 g of NaCl were simultaneously added to an aqueous solution containing 72 g of gelatin and 16 g of NaCl at a constant rate over a period of 32 minutes (Br=23 mol %).

During the first half of the above addition, $5\times10^{-7}$ mol of rhodium chloride and $5\times10^{-7}$ mol of $K_3IrCl_6$ were added thereto over a period of 10 minutes, each amount being per mol of silver. After soluble salts were removed, gelatin was added thereto, the pH of the emulsion was adjusted to 6.0 and the pAg was adjusted to 7.5. Chloroauric acid and hypo were then added thereto, and chemical sensitization was carried out at 60° C. The chemical sensitization time was chosen so as to give the highest sensitivity. To the emulsion, there were added 4-hydroxy-6-methyl-1,3,3a,7-tetrazaindene as a stabilizer and phenoxyethanol as an antiseptic agent.

After 110 ml of a 0.05% solution of sensitizing dye (I) was added to one kg of the thus-obtained emulsion, there were added hydroquinone (100 mg/m$^2$), polyethyl acrylate latex as a plasticizer in an amount of 25% based on the amount of gelatin binder and 2-bis(vinylsulfonylacetamido) ethane (85 mg/m$^2$) as a hardening agent. The resulting emulsion was coated on a polyester support in such an amount as to give a coating weight of 3.7 g/m$^2$ in terms of silver. The coating weight of gelatin was 2.0 g/m$^2$.

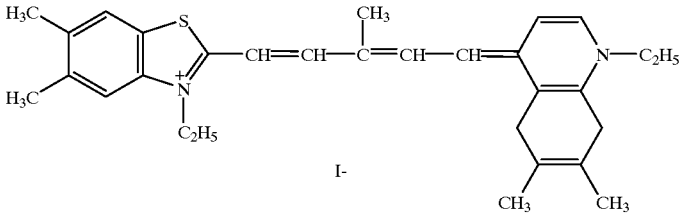

I-

A protective layer comprising gelatin (0.8 g/m$^2$), polymethyl methacrylate having an average particle size of 2.5$\mu$ (40 mg/m$^2$) as a matting agent, colloidal silica having an average particle size of 4 $\mu$ (30 mg/m$^2$), silicone oil (80mg/m$^2$), sodium dodecylbenzenesulfonate (80 mg/m $^2$) as coating aid, surfactant having the following structural formula (1), polyethyl acrylate latex (150 mg/m$^2$) and potassium salt of 1,1-disulfobutyl-3,3,3',3'-tetramethyl-5,5'-disulfoindolylcarbocyanine (6 mg/m$^2$) was coated thereon.

The polyester support of each sample had the following back layer and back protective layer on the opposite side of the support to the emulsion layer.

| Back layer | |
|---|---|
| Gelatin | 2.4 g/m$^2$ |
| Sodium dodecylbenzenesulfonate | 60 mg/m$^2$ |
| Dye (2) | 80 mg/m$^2$ |
| Dye (3) | 30 mg/m$^2$ |
| Potassium salt of 1,1'-disulfobutyl- | 80 mg/m$^2$ |

-continued

| | |
|---|---|
| 3,3,3',3'-tetramethyl-5,5'-disulfo-indolylcarbocyanine | |
| 1,3-Divinylsulfonyl-2-propanol | 60 mg/m$^2$ |
| Polypotassium vinylbenzenesulfonate | 30 mg/m$^2$ |
| Back protective layer | |
| Gelatin | 0.75 g/m$^2$ |
| Polymethyl methacrylate (average particle size: 3.5$\mu$) | 40 mg/m$^2$ |
| Sodium dodecylbenzenesulfonate | 20 mg/m$^2$ |
| Surfactant (1) | 2 mg/m$^2$ |
| Silicone oil | 100 mg/m$^2$ |

Surfactant (1)
$C_8F_{17}SO_2N(C_3H_7)$—$CH_2COOK$
Dye (2)

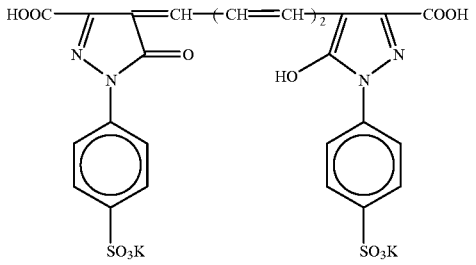

Dye (3)

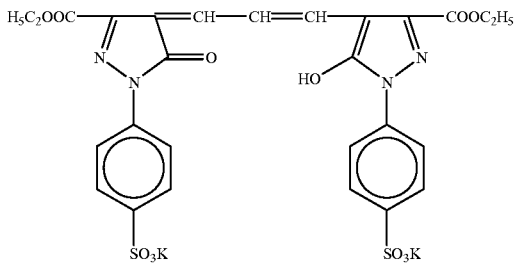

The thus-obtained samples were subjected to scanning exposure by using semiconductor laser having emission at 780 nm. In the same way as in Example A-1, running experiment was carried out by using the automatic processor FG-710NH (manufactured by Fuji Photo Film Co., Ltd.) using the same developing solutions and fixing solution as those used in Example A-1

Similar results to those obtained in Example A-1 was obtained, and it was found that when the developing solutions containing the compounds of the present invention were used, silver stain could be greatly reduced.

EXAMPLE A-5

Emulsions A and B were prepared in the following manner.

An aqueous solution of 0.5 M silver nitrate and an aqueous halide solution containing 0.1 M potassium bromide, 0.44 M sodium chloride, potassium hexachloroiridate(III) and ammonium hexabromorhodate (III) were added to an aqueous gelatin solution containing sodium chloride, 1,3-dimethylimidazolidine-2-thione and benzenethiosulfonic acid and having a pH of 4.0 with stirring at 38° C. over a period of 10 minutes by means of the double jet process to obtain silver chlorobromide grains having a mean grain size of 0.16 $\mu$m and a silver chloride content of 70 mol %, whereby nucleation was made. Subsequently, an aqueous solution of 0.5 M silver nitrate and an aqueous halide solution containing 0.1 M potassium bromide, 0.44 M sodium chloride and potassium ferrocyanide were added thereto over a period of 10 minutes by means of the double jet process to thereby complete the formation of grains. The resulting grains were silver chlorobromide cubic grains having a mean grain size of 0.2 $\mu$m and a silver chloride content of 70 mol % and containing $3.8\times10^{-7}$ mol of Ir, $6.1\times10^{-8}$ mol of Rh and $2.3\times10^{-5}$ mol of Fe, each amount being per mol of silver (a coefficient of variation: 10%). Washing with water was then carried out by conventional flocculation method, and 30 g of gelatin was added thereto. The resulting emulsion was divided into two equal parts, and emulsions A and B were prepared in the following manner.

Emulsion A

The pH of the emulsion was adjusted to 5.6 and the pAg was adjusted to 7.5. Subsequently, 3.2 mg of sodium thiosulfate and 4.3 mg of chloroauric acid were added thereto, and chemical sensitization was carried out at 65° C. so as to impart the optimum sensitivity. Further, 75 mg of 4-hydrroxy-6-methyl-1,3,3a,7-tetrazaindene as a stabilizer was added thereto.

Emulsion B

The pH of the emulsion was adjusted to 5.1 and the pAg was adjusted to 7.5. Subsequently, 2.2 mg of sodium thiosulfate, 0.85 mg of N,N-dimethylselenourea, 3.4 mg of sodium benzenethiosulfate, 0.85 g of sodium benzenesulfinate and 4.3 mg of chloroauric acid were added thereto. Chemical sensitization was carried out at 55° C. Further, 75 mg of 4-hydroxy-6-methyl-1,3,3a,7-tetrazaindene as a stabilizer was added thereto.

The following coloring matter was added to each of the emulsions A and B. Further, 234 mg of disodium 4,4'-bis(4,6-dinaphthoxypyrimidine-2-ylamino)stilbene disulfonate and 25 mg of 1-phenyl-5-mercaptotetrazole were added thereto, each amount being per mol of silver.

Furthermore, hydroquinone (150 mg/m$^2$), polyethyl acrylate latex in an amount of 25% based on the amount of gelatin binder, colloidal silica of 0.01 $\mu$m in an amount of 30% based on the amount of gelatin binder and 2-bis (vinylsulfonylacetamido)ethane (70 mg/m$^2$) as a hardening agent were added thereto. The resulting emulsion was coated on a polyester support in such an amount as to give a coating weight of 3.2 g/m$^2$ in terms of silver and a coating weight of 1.4 g/m$^2$ of gelatin. A protective layer comprising gelatin (0.5 g/m$^2$), the following dye (70 mg/m$^2$), polymethyl methacrylate having a particle size of 2.5 $\mu$m (60 mg/m $^2$) as a matting agent, colloidal silica having a particle size of 10 $\mu$m (70 mg/m$^2$), sodium dodecylbenzenesulfonate as a coating aid, the following fluorine-containing surfactant (1.5 mg/m $^2$) and a chelating agent (20 mg/m$^2$) and having a pH of 5.5 was coated on the emulsion layer simultaneously with the coating of the emulsion layer.

Coloring matter

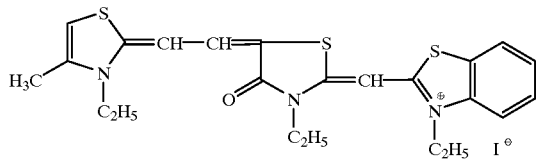

4.2 mg/m$^2$

-continued
Dye
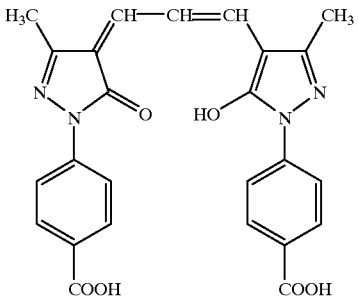
Surfactant
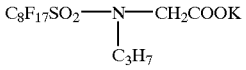
-continued
Chelating agent
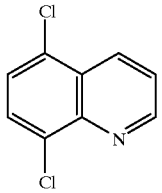
The base used in this Example had the following back layer and back protective layer.
| Back layer | |
|---|---|
| Gelatin | 2.0 g/m$^2$ |
| Sodium dodecylbenzene sulfonate | 80 mg/m$^2$ |
| 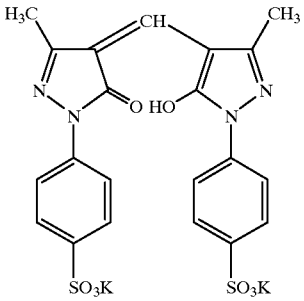 | 160 mg/m$^2$ |
| 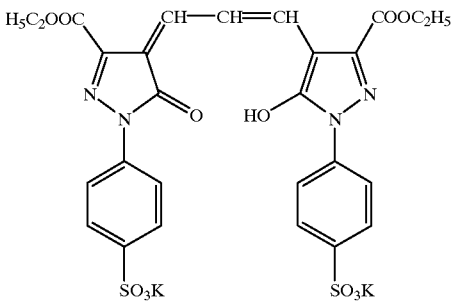 | 40 mg/m$^2$ |
| 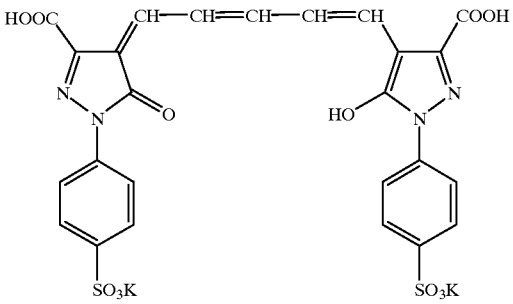 | 120 mg/m$^2$ |
| 1,3-Divinylsulfone-2-propanol | 60 mg/m$^2$ |

-continued

| Back protective layer | |
|---|---|
| Gelatin | 0.5 g/m$^2$ |
| Polymethyl methacrylate (particle size: 4.7 μm) | 30 mg/m$^2$ |
| Sodium dodecylbenzenesulfonate | 20 mg/m$^2$ |
| Fluorine-containing surfactant (having the above structural formula) | 2 mg/m$^2$ |
| Silicone oil | 100 mg/m$^2$ |

Evaluation of Photographic Performance

The resulting samples were exposed to light through an interference filter having a peak at 633 nm and a continuous wedge by using xenon flash light (emission time: $10^{-5}$ seconds), and sensitometry was carried out under the following temperature and time conditions by using an automatic processor FG-710NH manufactured by Fuji Photo Film Co., Ltd.

| | | |
|---|---|---|
| Development | 38° C. | 14 sec |
| Fixing | 37° C. | 9.7 sec |
| Rinsing | 26° C. | 9 sec |
| Squeeze | | 2.4 sec |
| Drying | 55° C. | 8.3 sec |
| Total | | 43.4 sec |
| Line speed | | 2800 mm/min |

The same developing solutions and fixing solution as those used in Example A-1 were used. Running experiment was carried out and similar results to those of Example A-1 were obtained. Accordingly, it was found that when the compounds of the present invention were used, silver stain could be greatly reduced without an adverse effect on photographic characteristics.

It will be understood from the above disclosures that when the developing solutions containing the compounds of the present invention are used, silver complex is scarcely dissolved out from the photographic materials into the developing solutions and silver stain deposited on the films is not formed even under severe running conditions, and the developing solutions containing the compounds of the present invention do not have an adverse effect on photographic characteristics.

EXAMPLE B-1

Preparation of Sample

Monodisperse cubic silver iodobromide grains containing $5\times10^{-8}$ mol (per mol of silver) of ammonium hexachlororhodate(III) and $5\times10^{-7}$ mol (per mol of silver) of potassium hexachloroiridate(III) and having an iodide content of 1.5 mol % and a mean grain size of 0.4 μm were subjected to gold-sulfur-selenium sensitization to prepare an emulsion (a coefficient of variation: 10%).

To the emulsion, there were added 40 mg of the above-described sensitizing dye B-6, 100 mg of the compound (d) as a supersensitizing dye, 1 g of the above-described dye E-11, 350 mg of the compound [h] and 100 mg of the compound [C] as anti-fogging agents, 25 g of colloidal silica having an average particle size of 10 μm, 400 g of a fluorescent brightener emulsion described in JP-B-3-27097 and 3 g of the compound [d] as a hardening agent, each amount being per mol of silver. The resulting emulsion was coated on a polyethylenelaminated paper support of 110 μm in thickness in such an amount as to give a coating weight of 1.3 g/m$^2$ in terms of silver and a coating weight of 1 g/m$^2$ of gelatin.

[a]

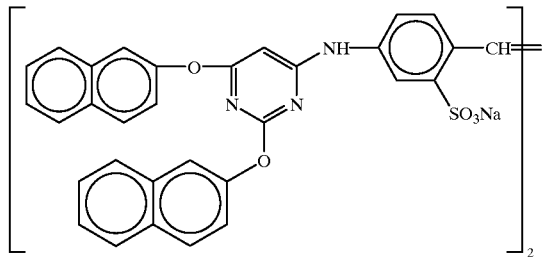

[b]

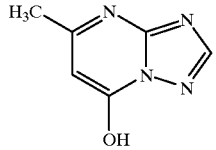

[c]

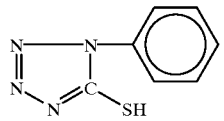

[d]

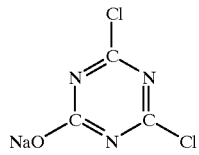

A protective layer having a composition indicated in Table B-1 was simultaneously coated on the emulsion layer.

TABLE B-1

| Protective layer | Amount added per m$^2$ |
|---|---|
| Gelatin | indicated in Table B-4 |
| Polymethyl methacrylate (an average particle size: 3.5 μm) | 30 mg |
| Hydroquinone | 150 mg |
| 1-Phenyl-3-pyrazolidone | 25 mg |
| $C_8F_{17}SO_2N(CH_3)-(CH_2CH_2O)_4-(CH_2)_4-SO_3Na$ | 7 mg |
| Polyethyl acrylate | 300 mg |

TABLE B-1-continued

| Protective layer | Amount added per $m^2$ |
|---|---|
| $C_{17}H_{33}CON(CH_3)CH_2CH_2SO_3Na$ | |

Processing was carried out under the following conditions by using an automatic processor FG-710 NH manufactured by Fuji Photo Film Co., Ltd.

| | | |
|---|---|---|
| Development | 38° C. | 14 sec |
| Fixing | 37° C. | 9.7 sec |
| Rinsing | 26° C. | 9 sec |
| Squeeze | | 2.4 sec |
| Drying | 55° C. | 8.3 sec |
| Total | | 43.4 sec |

Half-exposed samples were subjected to 30 $m^2$ running per day, and the evaluation of silver stain was made by the number of $m^2$ from which silver stain began to occur. The running was continued for two weeks. The results are shown in Table B-4.

The evaluation of residual color was visually made. The evaluation was made in five grades. The results are also shown in Table B-4.

Two developing solutions A and B given in Table B-2 were used. A fixing solution given in Table B-3 was used. It will be understood from Table B-4 that Nos. 3 and 4 according to the present invention give satisfactory results with regard to both silver stain and residual color.

TABLE B-2

| Developing solution | A | B |
|---|---|---|
| Sodium 1,2-dihydroxybenzene-3,5-disulfonate | 0.5 g | " |
| Diethylenetriaminepentaacetic acid | 2.0 g | " |
| Sodium carbonate | 5.0 g | " |
| Boric acid | 10.0 g | " |
| Potassium sulfite | 85.0 g | " |
| Sodium bromide | 6.0 g | " |
| Diethylene glycol | 40.0 g | " |
| 5-Methylbenztrizole | 0.2 g | " |
| Hydroquinone | 30.0 g | " |
| 4-Hydroxymethyl-4-methyl-1-phenyl-3-pyrazolidone | 1.6 g | " |
| 2,3,5,6,7,8-Hexahydro-2-thioxo-4-(1H)-quinazolidone | 0.05 g | — |

TABLE B-2-continued

| Developing solution | A | B |
|---|---|---|
| Sodium 2-mercaptobenzimidazole-5-sulfonate | 0.3 g | " |
| Add water to make | 1 liter | " |

TABLE B-3

| Fixing solution | |
|---|---|
| Sodium thiosulfate (anhydrous) | 150 g |
| Compound-1 | 0.1 mol |
| Sodium bisulfite | 30 g |
| Disodium ethylenediaminetetraacetate dihydrate | 25 g |
| Add water to make | 1 liter |

pH was adjusted to 6.0 by adding Sodium hydroxide.

Compound-1

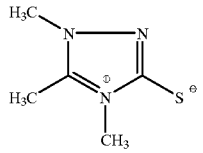

TABLE B-4

| No. | Gelatin in Protective layer ($g/m^2$) | Developing solution | Evaluation of residual color | The number of $m^2$ from which silver stain begins to occur | |
|---|---|---|---|---|---|
| 1 | 2.2 | A | 1 | not occurred | |
| 2 | 1.8 | A | 3 | " | |
| 3 | 1.5 | A | 4 | " | Invention |
| 4 | 0.7 | A | 5 | " | Invention |
| 5 | 2.2 | B | 2 | 250 | |
| 6 | 1.8 | B | 3 | 150 | |
| 7 | 1.5 | B | 4 | 75 | |
| 8 | 0.7 | B | 5 | 50 | |

EXAMPLE B-2

Preparation of Sample

Monodisperse cubic silver chlorobromide grains containing $1\times10^{-7}$ mol (per mol of silver) of ammonium hexachlororhodate(III), $7\times10^{-7}$ mol (per mol of silver) of potassium hexachloroiridate(III), $2\times10^{-5}$ mol (per mol of Ag) of potassium hexacyanoferrate(II) and a silver bromide content of 20 mol % and a mean grain size of 0.2 $\mu$m were subjected to gold-sulfur-selenium sensitization to prepare an emulsion.

To the emulsion, there were added 50 mg of the above-described sensitizing dye D-3, the following compounds [e] (150 mg) and [f] (500 mg) as supersensitizing agents, 500 mg of the aforesaid supersensitizing agent [a], 1.2 g of hydroquinone, 25 g of polyethyl acrylate and 7 g of the following compound [g] as a hardening agent, each amount being per mol of silver. The resulting emulsion was coated in such an amount as to give a coating weight of 1.2 $g/m^2$ in terms of silver and a coating weight of 1.2 $g/m^2$ of gelatin.

[e]

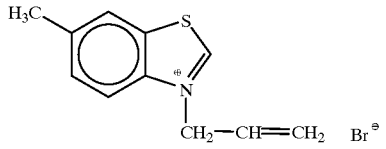

[f]

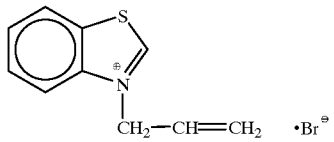

[g]

$(H_2C{=}CH{-}CH_2{-}CONH)_2CH_2$

A u layer having a composition given in Table B-5 and a protective layer having a composition given in Table B-6 were simultaneously coated under the emulsion layer to obtain each of samples indicated in Table B-7.

TABLE B-6

| Protective layer | Amount added per $m^2$ |
|---|---|
| Gelatin | indicated in Table B-7 |
| Polymethyl methacrylate (average particle size: 2.5 $\mu$m) | 35 mg |
| $C_{17}H_{33}CON(CH_3)CH_2CH_2SO_3Na$ | 100 mg |
| $C_8F_{17}SO_2N(C_3H_7)CH_2COOK$ | 2 mg |
| 1,5-Dihydroxy-2-benzaldoxime | 10 mg |
| Polyethyl acrylate | 300 mg |

The samples were evaluated in the same manner as in Example B-1. The results are shown in Table B-7.

TABLE B-5

| u layer | Coating weight per $m^2$ |
|---|---|
| Gelatin | 0.8 g |
| 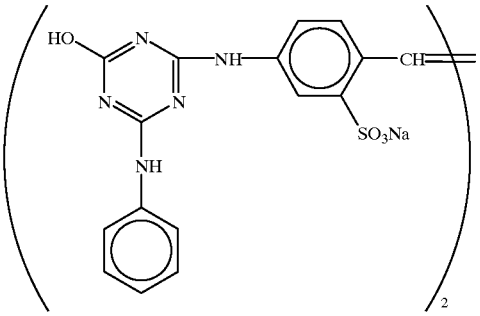 | 100 mg |
| The aforesaid dye | 30 mg |
| 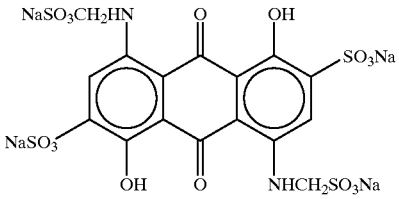 | 30 mg |
| Hydroquinone | 30 g |

TABLE B-7

| No. | Gelatin in Protective layer ($g/m^2$) | Developing solution | Evaluation of residual color | The number of $m^2$ from which silver stain begins to occur | |
|---|---|---|---|---|---|
| 1 | 2.2 | A | 1 | not occurred | |
| 2 | 1.8 | A | 3 | " | |
| 3 | 1.5 | A | 4 | " | Invention |
| 4 | 0.7 | A | 5 | " | Invention |
| 1 | 2.2 | B | 1 | 150 | |
| 2 | 1.8 | B | 2 | 100 | |
| 3 | 1.5 | B | 4 | 50 | |
| 4 | 0.7 | B | 5 | 30 | |

EXAMPLE B-3

The procedure of Example B-1 was repeated except that 20 mg of the sensitizing dye C-4, 20 mg of the sensitizing dye C-5 and 10 g of the dye E-2 were used in place of the sensitizing dye B-6, the sensitizing dye [a] and the dye E-11, respectively, to prepare samples. In the same manner as in Example B-1, the samples were evaluated. It was found that the samples of the present invention were superior as in Example B-1.

EXAMPLE C-1

(1) Preparation of Emulsion

| | |
|---|---|
| Solution I | |
| Water | 1000 ml |
| Gelatin | 20 g |
| Sodium chloride | 20 g |
| 1,3-Dimethylimidazolidine-2-thione | 20 mg |
| Sodium benzenesulfonate | 6 mg |
| Solution II | |
| Water | 400 mg |
| Silver nitrate | 100 g |
| Solution III | |
| Water | 400 ml |
| Sodium chloride | 30.5 g |
| Potassium bromide | 14 g |
| Potassium hexachloroiridate(III) (0.001% aqueous solution) | 15 ml |
| Ammonium hexabromorhodate(III) (0.001% aqueous solution) | 1.5 ml |

To the solution I kept at 38° C. and at a pH of 4.5 with stirring, there were simultaneously added the solution II and the solution III over a period of 10 minutes to form nucleus grains of 0.16 $\mu$m. Subsequently, the following solutions IV and V were added thereto over a period of 10 minutes. Further, 0.15 g of potassium iodide was added thereto to complete nucleation.

| | |
|---|---|
| Solution IV | |
| Water | 400 ml |
| Silver nitrate | 100 g |
| Solution V | |
| Water | 400 ml |
| Sodium chloride | 30.5 g |
| Potassium bromide | 14 g |
| $K_4Fe(CN)_6$ | $1 \times 10^{-5}$ mol/mol of Ag |

The emulsion was washed with water by conventional flocculation method, and 40 g of gelatin was added thereto. The pH of the emulsion was adjusted to 5.3, and the pAg was adjusted to 7.5. Subsequently, 5.2 mg of sodium thiosulfate, 10.0 mg of chloroauric acid and 2.0 mg of N,N-dimethylselenourea were added thereto. Further, 8 mg of sodium benzenesulfonate and 2.0 mg of sodium benzenesulfinate were added thereto, and chemical sensitization was carried out at 55° C. so as to impart the optimum sensitivity. There was finally obtained a silver iodochlorobromide cubic grain emulsion having a silver chloride content of 80 mol % and a mean grain size of 0.20 $\mu$m.

(2) Preparation of Coated Sample

The following sensitizing dye (1) ($5\times10^{-4}$ mol per mol of Ag) was added to the emulsion, and orthosensitization was carried out. Further, 2.5 g (per mol of Ag) of hydroquinone and 50 mg (per mol of Ag) of 1-phenyl-5-mercaptotetrazole as anti-fogging agents and 30% by weight (based on the amount of gelatin) of colloidal silica (average particle size: 0.015 $\mu$m, Snowtex C manufactured by Nissan Chemical Industries, Ltd.) were added thereto. Furthermore, 40% by weight (based on the amount of gelatin) of polyethyl acrylate latex (0.05 $\mu$m) as a plasticizer and 2-bis(vinylsulfonylacetamido)ethane, as a hardening agent, in an amount of 15 to 70 $mg/m^2$ per gram of the entire gelatin were added thereto so as to give a swelling ratio given in Table C-2.

The resulting coating solution was coated on a polyethylene terephthalate support in such an amount as to give a coating weight of 3.0 $g/m^2$ in terms of silver and a coating weight of 1.5 $g/m^2$ of gelatin. The following lower protective layer and upper protective layer were simultaneously coated on the emulsion layer. All samples had a kinetic friction coefficient of 0.22±0.03 (25° C., 60 RH, sapphire needle=1 mmϕ, load=100 g, speed=60 cm/min).

| | per $m^2$ |
|---|---|
| Lower protective layer | |
| Gelatin | 0.25 g |
| Sodium benzenethiosulfonate | 4 mg |
| 1,5-Dihydroxy-2-benzaldoxime | 25 mg |
| Polyethyl acrylate latex | 125 mg |
| Upper protective layer | |
| Gelatin | 0.25 g |
| Silica matting agent (average particle size: 2.5 $\mu$m) | 50 mg |
| Compound (1) (gelatin dispersion of lubricant) | 30 mg |
| Colloidal silica (Snowtex C manufactured by Nissan Chemical Industries, Ltd.) | 30 mg |

-continued

| | per $m^2$ |
|---|---|
| Compound (2) | 5 mg |
| Sodium dodecylbenzenesulfonate | 22 mg |

Sensitizing dye (1)

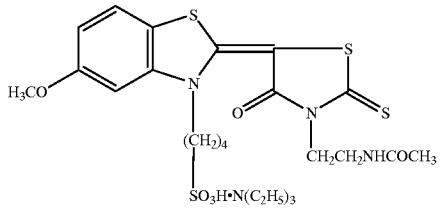

Compound (1)

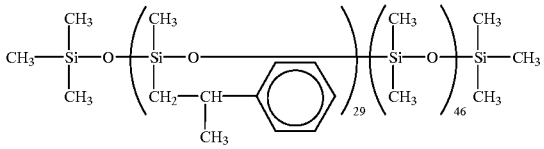

Compound (2)

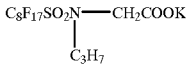

The support of the sample of this Example had the following back layer and back protective layer. The swelling ratio of (back layer+protective layer) was 98%.

| | |
|---|---|
| Back layer | |
| Gelatin | 2.0 $g/m^2$ |
| Sodium dodecylbenzenesulfonate | 80 $mg/m^2$ |
| Compound (3) | 70 $mg/m^2$ |
| Compound (4) | 70 $mg/m^2$ |
| Compound (5) | 90 $mg/m^2$ |
| 1,3-Divinylsulfonyl-2-propanol | 60 $mg/m^2$ |
| Back protective layer | |
| Gelatin | 0.5 $g/m^2$ |
| Polymethyl methacrylate fine particles (average particle size: 3.6 $\mu$m) | 40 $mg/m^2$ |
| Sodium dodecylbenzenesulfonate | 20 $mg/m^2$ |
| Compound (1) (gelatin dispersion of lubricant) | 100 $mg/m^2$ |
| Compound (2) | 2 $mg/m^2$ |

Compound (3)

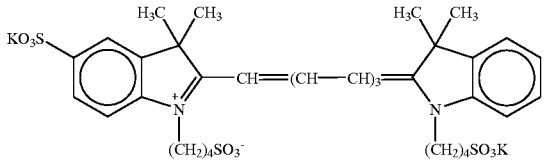

-continued

Compound (4)

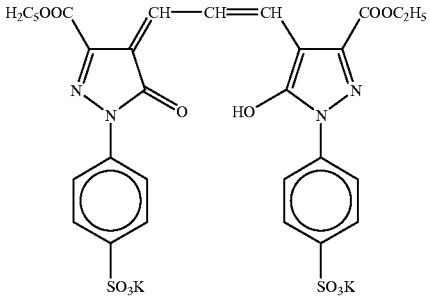

Compound (5)

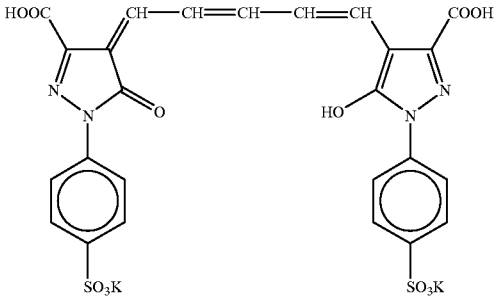

A developing solution having the following composition was prepared.

| | |
|---|---|
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenztriazole | 0.2 g |
| Hydroquinone | 30.0 g |
| 4-Hydroxymethyl-4-methyl-1-phenyl-3-pyrazolidone | 1.6 g |
| Compound of formula (I) | given in Table C-1 |
| Sodium 2-mercaptobenzimidazole-5-sulfonate | 0.3 g |
| Add water to make | 1 liter |

pH was adjusted to 10.7 by adding potassium hydroxide.

This developing solution was referred to as base, and testing developing solution indicated in Table C-1 were prepared.

TABLE C-1

| Developing Solution No. | Composition of developing solution |
|---|---|
| 1 | Compound of formula (I) was not contained |
| 2 | Compound I-4 (0.1 g/l) was contained |
| 3 | Compound I-3 (0.1 g/l) was contained |
| 4 | Compound I-6 (0.15 g/l) was contained |

The resulting samples were exposed to light through an interference filter having a peak at 488 nm and a continuous wedge by using xenon flash light (emission time: $10^{-6}$ sec), sensitometry was carried out under the following temperature and time conditions by using an automatic processor FG-710NH manufactured by Fuji Photo Film Co., Ltd., and running experiment was carried out.

The evaluation of photographic characteristics was determined by the relative sensitivity of an exposure amount giving a density of 3.0. The evaluation of silver stain was determined by the number of films from which silver stain began to occur when 1200 films were processed.

The swelling ratio was determined by measuring the thickness of the layer before swelling with a measuring force of 30±5 g and the thickness of the swollen layer with a measuring force of 2±0.5 g. The thickness was measured with an electron micrometer manufactured by Anritsu Electric Co., Ltd.

TABLE C-2

| Sample No. | Swelling ratio of (emulsion layer + protective layer) (%) | Developing solution No. | Photographic characteristics*1 Fresh solution | Photographic characteristics*1 Running solution | The number of films from silver stain began to occur*2 |
|---|---|---|---|---|---|
| 1 | 60 | 1 | 81 | 72 | 400 |
| 2 | 70 | " | 98 | 100 | 350 |
| 3 | 110 | " | 100 | 100 | 250 |
| 4 | 150 | " | 100 | 102 | 200 |
| 5 | 170 | " | 102 | 102 | 150 |
| 6 (Invention) | 60 | 2 | 95 | 93 | 1000 |
| 7 (Invention) | 70 | " | 98 | 100 | 900 |
| 8 (Invention) | 110 | " | 100 | 100 | 700 |
| 9 (Invention) | 150 | " | 100 | 102 | 600 |
| 10 | 170 | " | 102 | 102 | 400 |
| 11 (Invention) | 60 | 3 | 95 | 93 | 1000 |
| 12 (Invention) | 70 | " | 98 | 100 | 900 |
| 13 (Invention) | 110 | " | 100 | 100 | 700 |
| 14 (Invention) | 150 | " | 100 | 102 | 600 |
| 15 | 170 | " | 102 | 102 | 400 |
| 16 (Invention) | 60 | 4 | 95 | 93 | 1000 |
| 17 (Invention) | 70 | " | 98 | 100 | 900 |
| 18 (Invention) | 110 | " | 100 | 100 | 700 |
| 19 (Invention) | 150 | " | 100 | 102 | 600 |
| 20 | 170 | " | 102 | 102 | 400 |

*1Relative value when sensitivity obtained by using fresh solution of sample No. 4 is referred to as 100.
*2Practically usable level is not less than 500 films.

| | | |
|---|---|---|
| Development | 38° C. | 14 sec |
| Fixing | 37° C. | 9.7 sec |
| Rinsing | 26° C. | 9 sec |
| Squeeze | | 2.4 sec |
| Drying | 55° C. | 8.3 sec |
| Total | | 43.4 sec |
| Line speed | | 2800 mm/min |

Running conditions were such that 100 film having Daizenshi size (50.8 cm×61 cm) which were half-exposed were processed for one day and such running experiment as described above was continued for two weeks in total. There were processed 1200 films in total. The replenishment rate was 200 ml per $m^2$ of film.

The following fixing solution was used, and the replenishment rate thereof was 200 ml per $m^2$ of film.

| Fixing solution | |
|---|---|
| Sodium thiosulfate | 160 g/l |
| 1,4,5-trimethyl-1,2,4-triazolium-3-thiolate | 0.25 mol/l |
| Sodium bisulfite | 30 g/l |
| Disodium ethylenediaminetetraacetate dihydrate | 0.025 g/l |

pH was adjusted to 6.0 by adding sodium hydroxide.

It can be seen from Table C-2 that the samples of the present invention have a remarkable effect of preventing silver stain from occurring without detriment to photographic characteristics in rapid processing.

EXAMPLE C-2

An aqueous solution of 0.5 M silver nitrate and an aqueous halide solution containing 0.1 M potassium bromide, 0.44 M sodium chloride, potassium hexachloroiridate(III) and ammonium hexabromorhodate (III) were added to an aqueous gelatin solution containing sodium chloride, 1,3-dimethylimidazolidine-2-thione and benzenesulfonic acid and having a pH of 4.0 with stirring at 38° C. over a period of 10 minutes by means of the double jet process to obtain silver chlorobromide grains having a mean grain size of 0.16 μm and a silver chloride content of 70 mol %, whereby nucleation was carried out. Subsequently, an aqueous solution of 0.5 M silver nitrate and an aqueous halide solution containing 0.1 M potassium bromide, 0.44 M sodium chloride and potassium ferrocyanide were added thereto over a period of 10 minutes by means of the double jet process to thereby complete nucleation. The resulting grains were silver chlorobromide grains having a mean grain size of 0.2 μm and a silver chloride content of 70 mol % and containing $3.8\times10^{-7}$ mol (per mol of Ag) of Ir, $6.1\times10^{-8}$ mol (per mol of Ag) and $2.3\times10^{-5}$ mol (per mol of Ag) of Fe (a coefficient of variation: 10%). The emulsion was washed with water by conventional flocculation method, and 30 g of gelatin was added thereto. The ratio by weight of silver/gelatin was 2.5.

The pH of the emulsion was adjusted to 5.1 and the pAg thereof was adjusted to 7.5. Subsequently, 4.5 mg of sodium thiosulfate, 1.7 mg of N,N-dimethylselenourea, 6.8 mg of sodium benzenethiosulfonate, 1.7 mg of sodium benzenesulfonate and 8.6 mg of chloroauric acid were added thereto, and chemical sensitization was carried out at 55° C. by controlling the ripening time so as to provide the optimum sensitivity. Further, 160 mg of 4-hydroxy-6-methyl-1,3,3a, 7-tetrazaindene as a stabilizer was added thereto to prepare an emulsion.

To the emulsion, there was added 90 mg (per mol of silver) of the sensitizing dye (2). Further, 234 m g (per mol of silver) of disodium salt of 4,4'-bis(4,6-di-naphthoxypyrimidine-2-ylamino)stilbenedisulfonic acid and 25 mg of 1-phenyl-5-mercaptotetrazole were added thereto.

Furthermore, there w ere added hydroquinone (150 mg/m$^2$), polyethyl acrylate latex in an amount of 30% based on the amount of gelatin binder, colloidal silica of 0.01 $\mu$m in an amount of 30% based on the amount of gelatin binder and 2-bis(vinylsulfonylacetamido)ethane as a hardening agent in an amount of 15 to 70 mg/m$^2$ per one gram of total gelatin so as to give a swelling ratio indicated in Table C-3. The resulting emulsion was coated on a polyethylene terephthalate support having the following first and second undercoat layers on both sides thereof in such an amount as to give a coating weight of 3.2 g/m$^2$ in terms of silver and a coating weight of 1.4 g/m$^2$ of gelatin. A protective layer comprising gelatin in an amount given in Table C-3, the following dye (1) (70 mg/m$^2$), polymethyl methacrylate having an average particle size of 2.5 $\mu$m (60 mg/m$^2$) as a matting agent, colloidal silica (70 mg/m$^2$) having a particle size of 0.015 $\mu$m, sodium dodecylbenzenesulfonate as a coating aid, the following fluorine-containing surfactant (1.5 mg/m$^2$), the following chelating agent (200 mg/m$^2$) and the compound (1) (100 mg/m$^2$) and having a pH of 5.5 was coated on the emulsion layer simultaneously with the coating of the emulsion layer.

All samples obtained above had a Kinetic friction coefficient in the range of 0.18 to 0.30 (25° C., 60% RH, sapphire needle=2 mmϕ, load=100 g, speed=60 cm/min).

Sensitizing Dye (2)

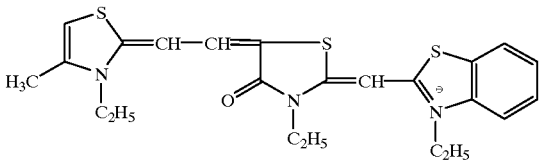

Dye (1)

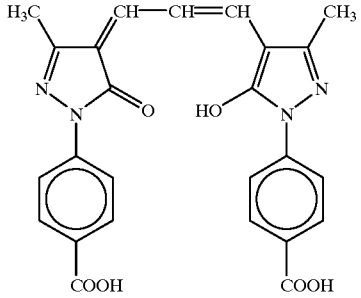

-continued

Surfactant

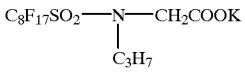

Chelating Agent

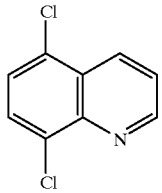

Compound (1)

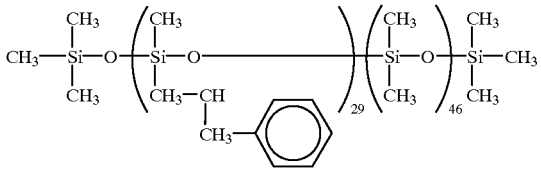

| First undercoat layer | Parts by weight |
|---|---|
| Aqueous dispersion of vinylidene chloride/methyl methacrylate/acrylonitrile/methacrylic acid (90/8/1/1) copolymer | 15 |
| 2,4-Dichloro-6-hydroxy-s-triazine | 0.25 |
| Fine particle of polystyrene (average particle size: 3$\mu$) | 0.05 |
| Compound 6 | 0.20 |
| Add water to make | 100 |

Further, 10 wt % KOH was added to adjust pH to 6, and the resulting coating solution was coated in such an amount as to give a dry layer thickness of 0.9$\mu$ at a drying temperature of 18° C. for 2 minutes.

| Second undercoat layer | Parts by weight |
|---|---|
| Gelatin | 1 |
| Methyl cellulose | 0.005 |
| Compound 7 | 0.02 |
| $C_{13}H_{25}O(CH_2CH_2O)_{10}H$ | 0.03 |
| Compound 8 | $3.5 \times 10^{-3}$ |
| Acetic acid | 0.2 |
| Add water to make | 100 |

The coating solution was coated in such an amount as to give a dry layer thickness of 0.1$\mu$ at a drying temperature of 170° C. for 2 minutes.

The following electrically conductive layer (surface resistivity: $2\times10^{10}$ Ω at 25° C. and 10% RH), back layer and back protective layer were simultaneously coated on the opposite side of the support to the emulsion layer.

| Electrically conductive layer | |
|---|---|
| $SnO_2$/Sb (9/1 by weight, average particle size: 0.25$\mu$) | 300 mg/m$^2$ |
| Gelatin ($Ca^{++}$ content: 30 ppm) | 170 mg/m$^2$ |

-continued

| | |
|---|---|
| Compound 8 | 7 mg/m$^2$ |
| Sodium dodecylbenzene sulfonate | 10 mg/m$^2$ |
| Dihexyl sodium α-sulfosuccinate | 40 mg/m$^2$ |
| Polysodium styrenesulfonate | 9 mg/m$^2$ |

Compound 6

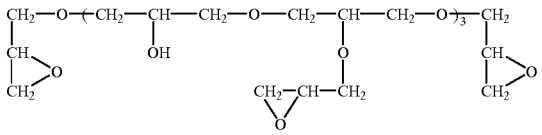

Compound 7

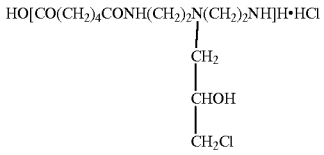

Compound 8

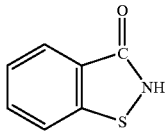

| Back layer | |
|---|---|
| Gelatin | 2.0 g/m$^2$ |
| Sodium dodecylbenzenesulfonate | 80 mg/m$^2$ |
| Dye (2) | 160 mg/m$^2$ |
| Dye (3) | 40 mg/m$^2$ |
| Dye (4) | 120 mg/m$^2$ |
| 1,3-Divinylsulfone-2-propanol | 60 mg/m$^2$ |
| **Back protective layer** | |
| Gelatin | 0.5 g/m$^2$ |
| Polymethyl methacrylate (average particle size: 4.7 μm) | 30 mg/m$^2$ |
| Sodium dodecylbenzenesulfonate | 20 mg/m$^2$ |
| Fluorine-containing surfactant described above | 2 mg/m$^2$ |
| Silicone Oil | 100 mg/m$^2$ |

-continued

Dye (2)

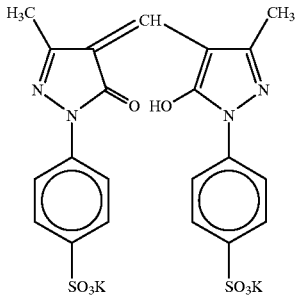

Dye (3)

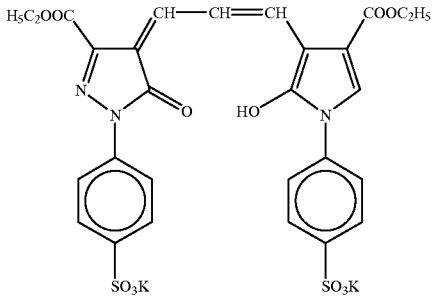

Dye (4)

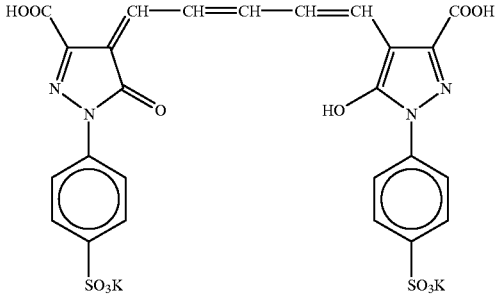

The thus-obtained samples were evaluated in the same manner as in Example C-1. The evaluation of photographic characteristics was made in the same manner as in Example C-1 except that an interference filter having a peak at 633 nm was used. The results are shown in Table C-3.

TABLE C-3

| Sample No. | Amount of gelatin in protective layer (g/m$^2$) | Swelling ratio (%) | Developing solution No. | Photographic characteristics *1 Fresh solution | Photographic characteristics *1 Running solution | The number of films from which silver stain began to occur *2 |
|---|---|---|---|---|---|---|
| 22 | 1.0 | 60 | 2 | 74 | 69 | 1100 |
| 23 | " | 70 | " | 78 | 74 | 980 |
| 24 | " | 110 | " | 83 | 79 | 900 |
| 25 | " | 150 | " | 91 | 85 | 800 |
| 26 | " | 200 | " | 93 | 89 | 400 |
| 27 (Invention) | 0.5 | 60 | " | 95 | 93 | 1000 |

TABLE C-3-continued

| Sample No. | Amount of gelatin in protective layer ($g/m^2$) | Swelling ratio (%) | Developing solution No. | Photographic characteristics *1 Fresh solution | Photographic characteristics *1 Running solution | The number of films from which silver stain began to occur *2 |
|---|---|---|---|---|---|---|
| 28 (Invention) | " | 70 | " | 98 | 100 | 900 |
| 29 (Invention) | " | 110 | " | 100 | 98 | 800 |
| 30 (Invention) | " | 150 | " | 100 | 102 | 700 |
| 31 | " | 200 | " | 102 | 102 | 350 |
| 32 (Invention) | 0.25 | 60 | 2 | 95 | 93 | 970 |
| 33 (Invention) | " | 70 | " | 100 | 100 | 880 |
| 34 (Invention) | " | 110 | " | 100 | 100 | 750 |
| 35 (Invention) | " | 150 | " | 100 | 100 | 690 |
| 36 | | 200 | " | 102 | 102 | 300 |
| 37 | 1.0 | 70 | 1 | 78 | 76 | 800 |
| 38 | | 150 | " | 81 | 81 | 600 |
| 39 | 0.5 | 70 | " | 98 | 100 | 350 |
| 40 | | 150 | " | 100 | 100 | 200 |
| 41 | 0.25 | 70 | " | 100 | 100 | 280 |
| 42 | | 150 | " | 100 | 100 | 150 |

*1: Relative value when sensitivity obtained by using fresh solution of sample No. 40 is referred to as 100.
*2: Practically usable level is not less than 500 films.

It can be seen from Table 3-C that the samples of the present invention have a remarkable effect of preventing silver stain from occurring without deteriment to photographic characteristic in rapid processing.

EXAMPLE C-3

To the emulsion obtained in Example C-1, there was added 80 mg of the sensitizing dye (3) per mol of Ag. Subsequently, 300 mg (per mol of Ag) of disodium salt of 4,4'-bis(4,6-dinaphthoxypyrimidine-2-ylamino)-stilbenedisulfonic acid and 450 mg (per mol of Ag) of 2,5-dimethyl-3-allyl-benzthiazole iodide as a super-sensitizing agent and a stabilizer were added thereto, and infrared sensitization was carried out. Further, there were added the anti-fogging agent, the plasticizer, the hardening agent and colloidal silica in the same manner as in Example C-1. The resulting emulsion was coated on a polyethylene terephthalate support in such an amount as to give a coating weight of 3.0 $g/m^2$ in terms of silver and a coating weight of 1.2 $g/m^2$ of gelatin. The following lower and upper protective layers were simultaneously coated on the emulsion layer.

| Lower protective layer | |
|---|---|
| Gelatin | 0.25 $g/m^2$ |
| Compound 9 | 20 $mg/m^2$ |
| Compound 10 | 10 $mg/m^2$ |
| Sodium dodecylbenzenesulfonate | 20 $mg/m^2$ |
| Polyethyl acrylate latex (0.005$\mu$) | 150 $mg/m^2$ |
| **Upper protective layer** | |
| Gelatin | 0.25 $g/m^2$ |
| Polymethyl methacrylate fine particles (average particle size: 3.4$\mu$) | 60 $mg/m^2$ |
| Colloidal silica (Snowtex C manufactured by Nissan Chemical Industries, Ltd.) | 30 $mg/m^2$ |
| Compound (1) (gelatin dispersion of lubricant) | 30 $mg/m^2$ |
| Sodium dodecylbenzenesulfonate | 40 $mg/m^2$ |
| Compound 11 | 10 $mg/m^2$ |

-continued

Sensitizing dye (3)

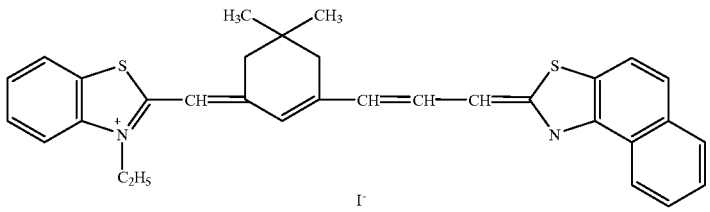

Compound 9

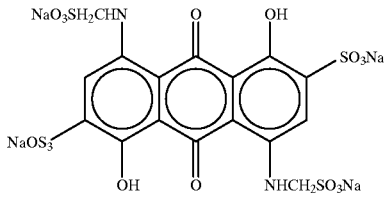

Compound 10

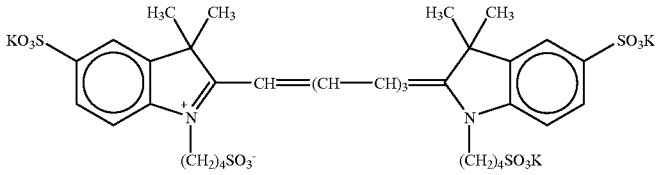

Compound (1)

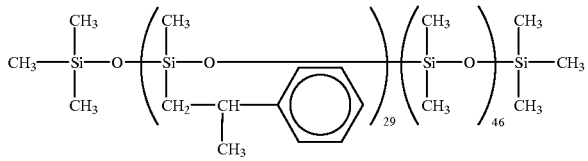

Compound 11

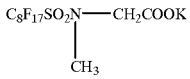

The following back layer and protective layer were coated on the opposite side of the support to the emulsion layer.

| Back layer | |
|---|---|
| Gelatin | 2.0 g/m$^2$ |
| Compound 12 | 34 mg/m$^2$ |
| Compound 13 | 90 mg/m$^2$ |
| Compound 14 | 70 mg/m$^2$ |
| Polyethyl acrylate latex (average particle size: 0.05$\mu$) | 400 mg/m$^2$ |
| Sodium dodecylbenzenesulfonate | 35 mg/m$^2$ |
| 1,3-Divinylsulfonyl-2-propanol | 50 mg/m$^2$ |

-continued

| | |
|---|---|
| Polysodium styrenesulfonate | 20 mg/m$^2$ |
| Protective layer | |
| Gelatin | 0.5 g/m$^2$ |
| Polymethyl methacrylate fine particles | 40 mg/m$^2$ |
| Sodium dodecylbenzenesulfonate | 10 mg/m$^2$ |
| Compound 15 | 2 mg/m$^2$ |
| Sodium acetate | 25 mg/m$^2$ |

-continued

Compound 12

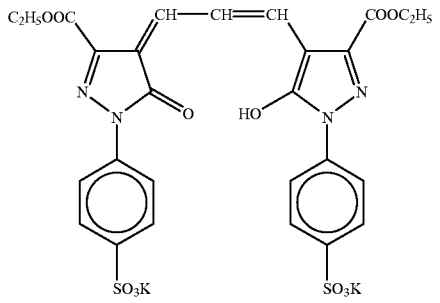

Compound 13

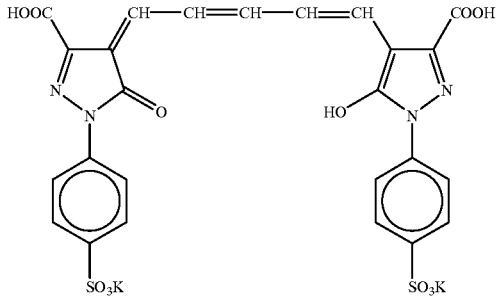

Compound 14

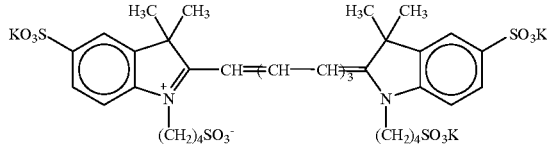

Compound 15

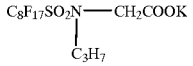

The thus-obtained samples were subjected to sensitometry under the following temperature and time conditions by using an automatic processor FG-460A manufactured by Fuji Photo Film Co., Ltd., and running experiment was carried out.

| Development Condition | | |
|---|---|---|
| Development | 38° C. | 13.5 sec. |
| Fixing | 36° C. | 12.7 sec. |
| Rinsing | 25° C. | 12.3 sec. |
| Drying | 55° C. | 16.2 sec. |
| Total | | 54.7 sec. |
| Line Speed | | 1519 mm/min |

Running conditions were such that after exposure at a rate of 50% of area blackened, 130 sheets of photographic materials having a quarter size (254 mm×305 mm) per day were processed by using the developing solution Nos. 1 and 2 and fixing solution of Example C-1, and the processing was continuously carried out for two weeks by the replenishment rates indicated in Table C-4. the evaluation of the occurrence of silver stain, photographic characteristics and clear in fixing was made.

(1) In the evaluation of the photographic characteristics, the samples were exposed to light through an interference filter having a peak at 780 nm and a continuous wedge by using xenon flash light (emission time: $10^{-6}$ sec) and developed. (2) Clear in fixing was evaluated by transparency when unexposed photographic materials having a quarter size were processed. The results are shown in Table C-5. It can be seen from Table C-5 that the samples of the present invention enable the amounts of the developing solution and the fixing solution to be reduced and have a remarkable effect of preventing silver stain from occurring without deteriment to rapid processability.

The criterion of clear in fixing is as follows.

5: The whole surface is transparent.

4: At least ¾ of the whole is transparent.

3: At least ⅔ of the whole is transparent.

2: At least ¼ of the whole is transparent.

1: The whole surface is opaque.

TABLE C-4

| Sample No. | Swelling ratio*1 (%) | Replenishment rate (ml/m²) Developing solution | | Fixing solution |
|---|---|---|---|---|
| 43 (Invention) | 70 | No. 2 | 250 | 250 |
| 44 (Invention) | " | " | 200 | 200 |
| 45 (Invention) | " | " | 150 | 150 |
| 46 (Invention) | " | " | 100 | 100 |
| 47 (Invention) | 150 | " | 250 | 250 |
| 48 (Invention) | " | " | 200 | 200 |
| 49 (Invention) | " | " | 150 | 150 |
| 50 (Invention) | " | " | 100 | 100 |
| 51 | 70 | No. 1 | 250 | 250 |
| 52 | " | " | 150 | 150 |
| 53 | 150 | " | 250 | 250 |
| 52 | " | " | 150 | 150 |

*1Swelling ratio is a value determined by the same method as in Example C-4.

TABLE C-5

| Sample No. | Photographic characteristics*1 Fresh solution (%) | Photographic characteristics*1 Fresh solution Running solution | Clear in fixing Fresh solution | Clear in fixing Running solution | The number of films from which silver stain began to occur*2 |
|---|---|---|---|---|---|
| 43 (Invention) | 100 | 100 | 5 | 5 | 1400 |
| 44 (Invention) | " | " | " | " | " |
| 45 (Invention) | " | " | " | " | 1350 |
| 46 (Invention) | " | 98 | " | " | 1300 |
| 47 (Invention) | 100 | 100 | 5 | 5 | 1400 |
| 48 (Invention) | " | " | " | " | 1380 |
| 49 (Invention) | " | " | " | " | 1330 |
| 50 (Invention) | " | " | " | " | 1250 |
| 51 | 100 | 100 | 5 | 5 | 600 |
| 52 | " | " | " | " | 550 |
| 53 | 100 | 100 | 5 | 5 | 500 |
| 54 | " | " | " | " | 400 |

*1Relative value when sensitivity obtained by using fresh solution of Sample No. 53 is referred to as 100.
*2Practically usable level is not less than 650 films.

While the present invention has been described in detail and with reference to specific embodiments thereof, it will be apparent to one skilled in the art that various changes and modifications can be made therein without departing from the spirit and the scope of the present invention.

What is claimed is:

1. A method for processing a silver halide photographic material comprising a support having thereon at least one silver halide emulsion layer, comprising processing with a developing solution which contains a six-membered heterocyclic compound having two nitrogen atoms as the constituent atoms of the six-membered ring and a mercapto group, a hydroxyl group and at least one substituent group other than a hydrogen atom and a five-membered heterocyclic compound having two to three nitrogen atoms as the constituent atoms of the five-membered ring and at least one mercapto group, wherein said six-membered heterocyclic compound is a compound represented by the following general formula (I) and said five-membered heterocyclic compound is a compound represented by the following general formula (II):

(I)

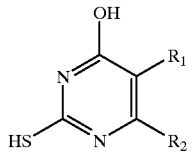

wherein, one of $R^1$ and $R^2$ represents an alkyl group having from 1 to 10 carbon atoms which may be substituted or unsubstituted, an aryl group having from 6 to 12 carbon atoms, an aralkyl group having from 7 to 12 carbon atoms, a nitro group, a cyano group or a halogen atom, provided that when $R^2$ is an alkyl group, the alkyl group is unsubstituted; and the sum total of carbon atoms in $R^1$ and $R^2$ is from 2 to 20; or $R^1$ and $R^2$ may be combined together to form a five-membered or six-membered ring;

(II)

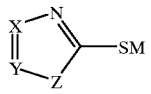

wherein X and Y each represents a nitrogen atom or $CR_3$; Z represents $NR_4$; X and Y may be combined together to form a condensed ring; $R_3$ and $R_4$ each represents a hydrogen atom, an alkyl group, an aryl group, an aralkyl group, a hydroxyl group, a nlercapto group, a carboxyl group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group; and M represents a hydrogen atom, an alkali metal atom, a quatemary amnionium or a quaterny phosphonium, and wherein both of the compounds of formulae (I) and (II) are used in an amount of from 0.01 to 100 mmol per liter.

2. A method for processing a silver halide photographic material comprising a support having thereon at least one silver halide emulsion layer with a developing solution as in claim 1, wherein X and Y in formula (II) are combined together to form a benzene ring.

3. A method for processing a silver halide photographic material comprising a support having thereon at least one silver halide emulsion layer with a developing solution as in claim 1, wherein both of the compounds of formulae (I) and (II) are needed in an amount of from 0.1 to 10 mmol per liter.

4. The method of claim 1, wherein $R_1$ of formula (1) is a hydrogen atom or an alkyl group, and $R_2$ represents an unsubstituted alkyl group having from 1 to 10 carbon atoms or a substituted aryl group having 6 to 12 atoms.

5. A method for processing a silver halide photographic material comprising a support having thereon at least one silver halide emulsion layer, comprising processing with a developing solution which contains a six-membered heterocyclic compound having two nitrogen atoms as the constituent atoms of the six-membered ring and a mercapto group, a hydroxyl group and at least one substituent group other than hydrogen atom and a five-membered heterocyclic compound having two to three nitrogen atoms as the constituent atoms of the five-membered ring and at least one mercapto group, wherein said six-membered heterocyclic compound is a compound represented by the following general formula (I) and said five-membered heterocyclic compound is a compound represented by the following general formula (II):

(I)

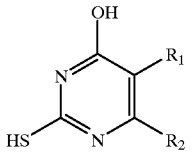

wherein $R_1$ and $R_2$ each represents hydrogen atom, an alkyl group having 1 to 10 carbon atoms, an aryl group, an aralkyl group, a hydroxyl group, a mercapto group, a carboxyl group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group, further providing that one of $R_1$ and $R_2$ is an alkyl group, an aryl group, an aralkyl group, a nitro group, a cyan group or a halogen atom, or $R_1$ and $R_2$ may be combined together to form a ring, and wherein the sum total of carbon atoms in $R_1$ and $R_2$ is 2 to 20 and when $R_1$ represents an alkyl group, the alkyl group may be unsubstituted or substituted by a hydroxy group, a dimethylamino group, a morpholino group, an N-methylpiperazinyl group or a pyrrolidinyl group, and when $R_2$ is an alkyl group, the alkyl group is unsubstituted:

(II)

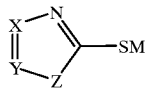

wherein X and Y each represents a nitrogen atom or $CR_3$; Z represents $NR_4$; X and Y may be combined together to form a condensed ring; $R_3$ and $R_4$ each represents a hydrogen atom, an alkyl group, an aryl group, an aralkyl group a hydroxyl group, a mercapto group, a carboxyl group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group; and M represents a hydrogen atom, an alkali metal atom, a quaternary ammonium or a quaternary phosphonium, and wherein both of the compounds of formulae (I) and (II) are used in an amount of from 0.01 to 100 mmol per liter, said processing constitutes continuous processing, and said continuous processing is carried out for at least three days.

* * * * *